US011783793B1

(12) United States Patent
Lin et al.

(10) Patent No.: US 11,783,793 B1
(45) Date of Patent: Oct. 10, 2023

(54) DISPLAY PANEL AND DISPLAY DEVICE

(71) Applicant: Xiamen Tianma Micro-Electronics Co., Ltd., Xiamen (CN)

(72) Inventors: Yiqiang Lin, Xiamen (CN); Hao Wu, Xiamen (CN); Poping Shen, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 18/049,760

(22) Filed: Oct. 26, 2022

(30) Foreign Application Priority Data

Jun. 30, 2022 (CN) ..... 202210772752.4

(51) Int. Cl.
*G09G 3/36* (2006.01)

(52) U.S. Cl.
CPC ..... *G09G 3/3659* (2013.01); *G09G 3/3614* (2013.01); *G09G 2300/0426* (2013.01); *G09G 2300/0819* (2013.01); *G09G 2310/0202* (2013.01); *G09G 2310/06* (2013.01); *G09G 2310/08* (2013.01); *G09G 2320/0247* (2013.01)

(58) Field of Classification Search
CPC ..... G09G 2300/0426; G09G 2300/043; G09G 2300/0842; G09G 2310/08
See application file for complete search history.

(56) References Cited

U.S. PATENT DOCUMENTS

2022/0140037 A1* 5/2022 Park ..... H10K 59/1213 257/40
2022/0199747 A1* 6/2022 Jung ..... H10K 59/1216
2022/0208088 A1* 6/2022 Kim ..... H10K 59/124
2022/0285474 A1* 9/2022 Kim ..... H10K 59/1213
2022/0320215 A1* 10/2022 Lee ..... G09G 3/3233
2022/0366847 A1* 11/2022 An ..... G09G 3/2003
2022/0384548 A1* 12/2022 Keum ..... H10K 59/1213

FOREIGN PATENT DOCUMENTS

CN 109448631 A * 3/2019
CN 109448631 A 3/2019
CN 115035873 A * 9/2022

* cited by examiner

*Primary Examiner* — Van N Chow
(74) *Attorney, Agent, or Firm* — CHRISTENSEN O'CONNOR JOHNSON KINDNESS PLLC

(57) ABSTRACT

A display panel includes data lines and scanning lines in a display region, and a demultiplexer in a non-display region. The demultiplexer includes m branches. m is an integer. m≥2. Each branch includes a switching transistor which includes a first electrode coupled with an input terminal of the demultiplexer, a second electrode coupled with one of the data lines, and a control electrode for receiving a switching control signal. The demultiplexer includes a first demultiplexer including a compensation transistor, of which first and second electrodes are short-circuited. The compensation transistor is coupled with the data line and has a control electrode for receiving a compensation control signal. The compensation control signal received by the compensation transistor in the branch has one functional rising edge in a period during which the scanning line provides an effective level signal once.

20 Claims, 13 Drawing Sheets

DISPLAY PANEL AND DISPLAY DEVICE

CROSS-REFERENCE TO RELATED APPLICATIONS

The present application claims priority to Chinese Patent Application No. 202210772752.4, filed on Jun. 30, 2022, the content of which is incorporated herein by reference in its entirety.

TECHNICAL FIELD

The present disclosure relates to the field of display technologies, and in particular, to a display panel and a display device.

BACKGROUND

In a liquid crystal display technology, a display panel includes a pixel electrode and a common electrode, voltages are respectively applied to the pixel electrode and the common electrode, and an electric field generated by a voltage difference between the pixel electrode and the common electrode is used to drive liquid crystal molecules to deflect, and then adjust a light transmittance of the liquid crystal. In order to avoid polarization phenomenon of the liquid crystal molecules when the liquid crystal molecules are driven by the same polarity voltage, a liquid crystal display panel is driven by an alternating current (AC) driving manner. The AC driving manner means that both positive and negative polarities are required to drive the liquid crystal when each frame is displayed. In the related art, there is a problem of display flickering when adopting the AC driving manner.

SUMMARY

In a first aspect, an embodiment of the present disclosure provides a display panel. The display panel has a display region and a non-display region. The display panel includes data lines arranged in the display region, scanning lines arranged in the display region, and at least one demultiplexer arranged in the non-display region. Each demultiplexer of the at least one demultiplexer includes m branches, where m is an integer, and m≥2. Each of the m branches includes a switching transistor. The switching transistor includes a first electrode coupled with an input terminal of the demultiplexer, a second electrode coupled with one of the data lines, and a control electrode configured to receive a switching control signal. The at least one demultiplexer includes at least one first demultiplexer. Each of m branches of each of the at least one first demultiplexer includes a compensation transistor. The compensation transistor includes a first electrode coupled with the second electrode of the switching transistor, a second electrode coupled with the first electrode of the compensation transistor, and a control electrode configured to receive a compensation control signal. The compensation control signal received by the compensation transistor has one functional rising edge within a period during which one of the scanning lines provides an effective level signal once.

In a second aspect, the display device includes a display panel. The display panel has a display region and a non-display region. The display panel includes data lines arranged in the display region, scanning lines arranged in the display region, and at least one demultiplexer arranged in the non-display region. Each demultiplexer of the at least one demultiplexer includes in branches, where m is an integer, and m≥2. Each of the m branches includes a switching transistor. The switching transistor includes a first electrode coupled with an input terminal of the demultiplexer, a second electrode coupled with one of the data lines, and a control electrode configured to receive a switching control signal. The at least one demultiplexer includes at least one first demultiplexer. Each of m branches of each of the at least one first demultiplexer includes a compensation transistor. The compensation transistor includes a first electrode coupled with the second electrode of the switching transistor, a second electrode coupled with the first electrode of the compensation transistor, and a control electrode configured to receive a compensation control signal. The compensation control signal received by the compensation transistor has one functional rising edge within a period during which one of the scanning lines provides an effective level signal once.

BRIEF DESCRIPTION OF DRAWINGS

In order to more clearly illustrate technical solutions of embodiments of the present disclosure or the technical solutions in the related art, the accompanying drawings used in the embodiments or the related art are briefly described below. The drawings described below are merely some of the embodiments of the present disclosure. Based on these drawings, those skilled in the art can obtain other drawings.

DESCRIPTION OF EMBODIMENTS

Figure 1:
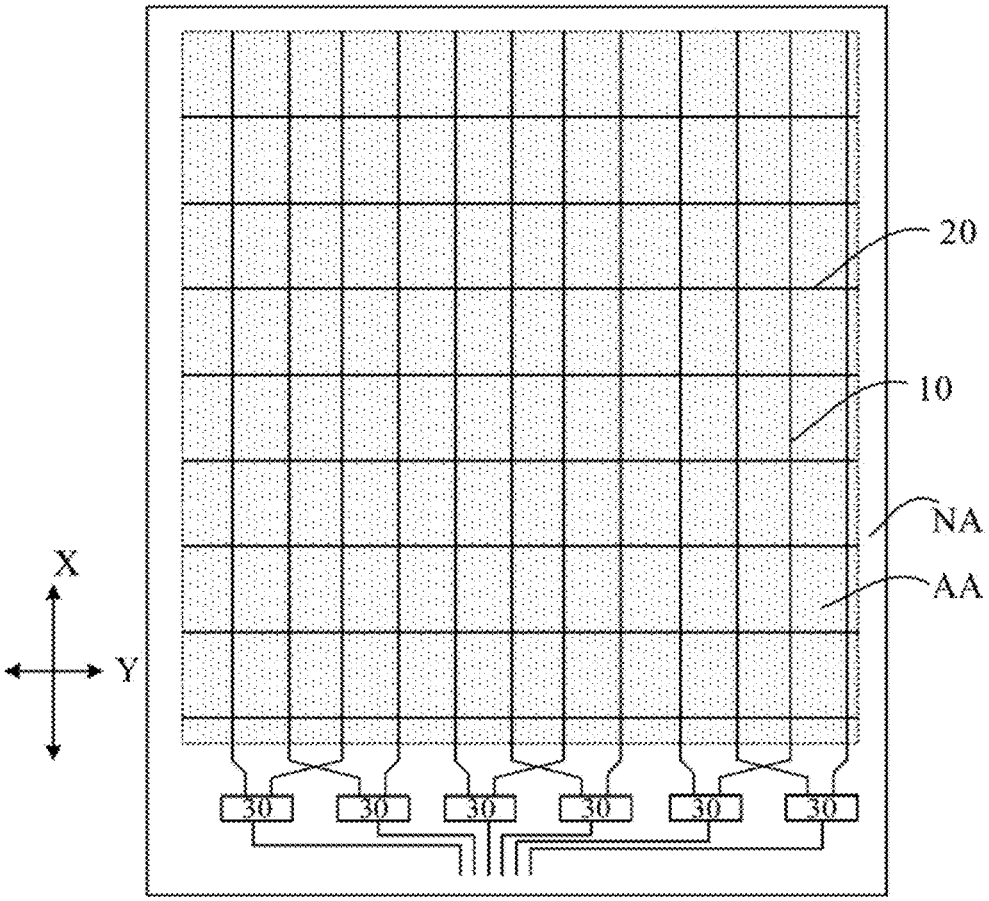
FIG. 1 is a schematic diagram of a display panel according to an embodiment of the present disclosure.

In order to make the purposes, technical solutions, and advantages of the embodiments of the present disclosure clearer, the technical solutions in the embodiments of the present disclosure will be clearly and completely described below with reference to the accompanying drawings in the embodiments of the present disclosure. The described embodiments are merely some embodiments of the embodiments of the present disclosure rather than all of the embodiments, all other embodiments obtained by those of ordinary skill in the art without creative efforts shall fall within the protection scope of the present disclosure.

The terms used in the embodiments of the present disclosure are merely describing exemplary embodiments and not intended to limit the present disclosure. Unless otherwise noted in the context, the expressions "a", "an", and "the" in singular form in the embodiments and appended claims of the present disclosure are also intended to represent a plural form.

When a liquid crystal display panel is driven by the AC driving manner for display, a common voltage with a fixed voltage is applied to the common electrode, it requires that, when displaying the same grayscale, a voltage difference between a positive polarity voltage applied on the pixel electrode and the common voltage equals to a voltage difference between a negative polarity voltage applied on the pixel electrode and the common voltage. When displaying the same grayscale, if the voltage difference between the positive polarity voltage and the common voltage is different from the voltage difference between the negative polarity voltage and the common voltage, the light transmittance of the liquid crystal driven by the two polarities are different, which causes display flickering.

The reasons for the display flickering of the display panel in the related art are researched. A display panel includes multiplexers, the multiplexers are coupled to data lines, respectively, and gating switches (i.e., switching transistors) in the multiplexers are all n-type transistors, so voltages on the data lines are affected by gate voltages of the gating switches. When the gating switch is turned off, a gate voltage of the gating switch transition jumps from a high level to a low level, then the voltage on the data line is decreased by coupling, so that a voltage actually written to the data line is different from a voltage provided to the data line. The voltage difference between the voltage actually written to the data line and the voltage provided to the data line is a feed-through voltage caused by the data voltage affected by coupling of the gate voltage of the gating switch. When different data lines are coupled with the gate voltages of the gating switches in different degrees, the feed-through voltages on different data lines are different, resulting in greater difference in common voltages required for positive and negative polarity data signals transmitted on different data lines. Taking a case that grayscales corresponding to ±5V is displayed as an example, assuming that the feed-through voltage on a data line caused by coupling of the gate voltage of the gating switch is −0.2V, then a data voltage actually written to the data line is +4.8V when a data voltage of +5V is supplied to the data line, a data voltage actually written to the data line is −5.2V when a data voltage of −5V is supplied to the data line. In a case that the AC driving manner is used, in order to make the voltage difference between the positive polarity voltage and the common voltage equal to the voltage difference between the negative polarity voltage and the common voltage, the common voltage required by this data line is −0.2V. Assuming that the feed-through voltage on another data line caused by coupling of the gate voltage of the gating switch is −0.1V, then a data voltage actually written to the data line is +4.9V when a data voltage of +5V is supplied to the data line, a data voltage actually written to the data line is −5.1V when a data voltage of −5V is supplied to the data line. In a case that the AC driving manner is used, in order to make the voltage difference between the positive polarity voltage and the common voltage equal to the voltage difference between the negative polarity voltage and the common voltage, the common voltage required by this data line is −0.1V. When a uniform common voltage is supplied to the display region, due to different common voltages required by different data lines, the voltage difference between the positive polarity voltage transmitted on a certain data line and the common voltage is different from the voltage difference between the negative polarity voltage transmitted on the data line and the common voltage, which results in different light transmittances of the liquid crystal driven by the two polarities, thereby causing display flickering.

In order to solve the above problem in the related art, some embodiments of the present disclosure provide a display panel. In the provided display panel, a compensation transistor is provided in at least one of the demultiplexers to compensate the coupling effect on the data line caused by the gate voltage when the switching transistor in the demultiplexer is controlled to be turned off and reduce or eliminate the feed-through voltage on the data line caused by coupling of the gate voltage of the gating switch, thereby avoiding display flickering.

FIG. 1 is a schematic diagram of a display panel according to an embodiment of the present disclosure. As shown in FIG. 1, the display panel includes a display region AA and a non-display region NA. The display panel includes multiple data lines 10 each extending along a first direction X and multiple scanning lines 20 each extending along a second direction Y, and multiple data lines 10 and the multiple scanning lines 20 are arranged in the display region AA. The first direction X and the second direction Y intersect. The extension directions of the data lines 10 and the scanning lines 20 intersect to define multiple sub-pixels. The sub-pixel includes pixel switches and a pixel electrode. The pixel switch is a transistor. A control electrode of the pixel switch is coupled with the scanning line 20. A first electrode of the pixel switch is coupled with the data line 10, and a second electrode of the pixel switch is coupled with the pixel electrode. One data line 10 is coupled with multiple sub-pixels, and one scanning line 20 is coupled with multiple sub-pixels. In some embodiments, multiple sub-pixels are arranged along the second direction Y to form in a pixel row, and one scanning line 20 is configured to drive multiple sub-pixels in one pixel row; and multiple sub-pixels are arranged along the first direction X to form a pixel column, and one data line 10 is configured to drive multiple sub-pixels in one pixel column.

When the display panel is driven for display, the scanning line 20 provides a scanning signal. When the scanning signal is an effective level signal, the pixel switch in the sub-pixel coupled to the scanning line 20 is turned on, so that the pixel electrode is conductive with the data line 10 to write a data signal to the pixel electrode through the data line 10. The display panel also includes a common electrode, and a voltage difference is formed between the pixel electrode and the common electrode, thereby generating an electric field to drive liquid crystal molecules to deflect, to display the sub-pixel.

The display panel includes at least one demultiplexer 30 located in non-display region NA. The demultiplexer 30 includes m branches, and one branch is coupled with one data line 10, that is, one demultiplexer 30 is coupled with m data lines 10, where m is an integer, and m≥2. FIG. 1 illustrates that m=2.

Figure 2:
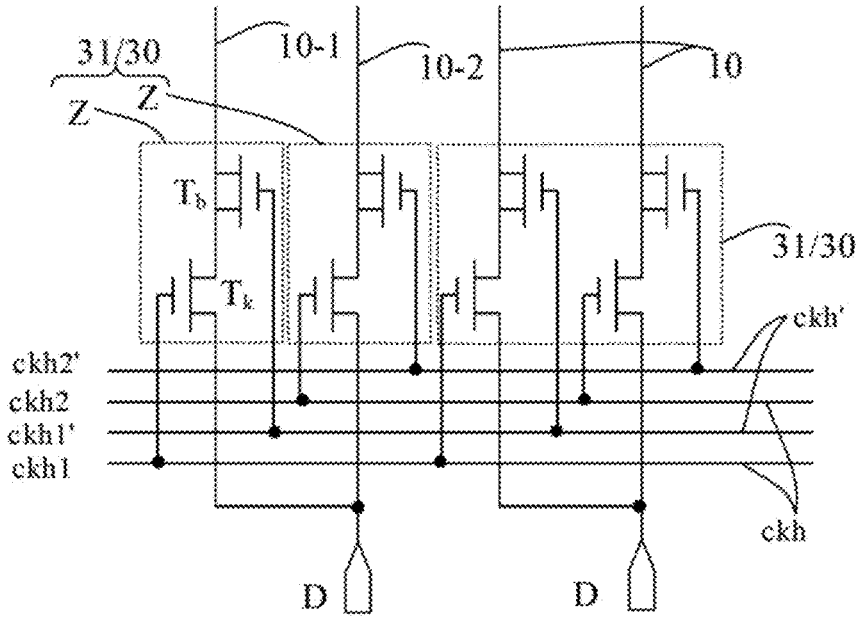
FIG. 2 is a schematic circuit diagram of a display panel according to an embodiment of the present disclosure.

FIG. 2 is a schematic circuit diagram of a display panel according to an embodiment of the present disclosure, and two demultiplexers 30 are shown in FIG. 2. An input terminal of each demultiplexer 30 is coupled with a data signal terminal D corresponding to the demultiplexer 30. The data signal terminal D is configured to provide a data signal. As shown in FIG. 2, in a case where m=2, the demultiplexer 30 includes two branches Z. One branch Z includes one switching transistor $T_k$. A first electrode of the switching transistor $T_k$ is coupled with the input terminal of the demultiplexer 30, a second electrode of the switching transistor $T_k$ is coupled with one data line 10, and a control electrode of the switching transistor $T_k$ is used for receiving a switching control signal. The switching transistor $T_k$ is turned on under control of the switching control signal, so that the data line 10 in the branch Z including the switching transistor $T_k$ is conductive with the input terminal of the demultiplexer 30, so as to write the data signal to the data line 10. The control electrodes of the switching transistors $T_k$ in demultiplexer 30 receive corresponding switching control signals. In the two branches Z shown in FIG. 2, the control electrode of the switching transistor $T_k$ in a first branch Z receives a first switching control signal CKH1, and the control electrode of the switching transistor $T_k$ in a second branch Z receives a second switching control signal CKH2. Among the two data lines 30 coupled with the same demultiplexer 30, a first data line 10-1 is coupled with the first branch Z, and a second data line 10-2 is coupled with the second branch Z. The control electrode of the switching transistor $T_k$ is the gate electrode of the switching transistor $T_k$.

In the embodiments of the present disclosure, the demultiplexer 30 includes the first demultiplexer. The branch Z of the first demultiplexer 31 includes the compensation transistor $T_b$. The first electrode of the compensation transistor $T_b$ is coupled with the second electrode of the switching transistor $T_k$, that is, the first electrode of the compensation transistor $T_b$ is coupled with the data line 10. The second electrode of the compensation transistor $T_b$ is coupled with the first electrode of the compensation transistor $T_b$. The compensation transistor $T_b$ includes a gate electrode, a source electrode and a drain electrode. The control electrode of the compensation transistor $T_b$ is the gate electrode. One of the first electrode and the second electrode of the compensation transistor $T_b$ is the source electrode, and the other one of the first electrode and the second electrode of the compensation transistor $T_b$ is the drain electrode. In the embodiments of the present disclosure, the source electrode and drain electrode of the compensation transistor $T_b$ are short-circuited, so the compensation transistor $T_b$ is equivalent to a wire connected to the data line 10, and the compensation transistor $T_b$ has no current leaking to the data line 10. A control electrode of the compensation transistor $T_b$ is configured to receive a compensation control signal. The compensation transistor $T_b$ is provided in each branch Z. In the embodiments of the present disclosure, types of the compensation transistor $T_b$ and the switching transistor $T_k$ are the same, and both the compensation transistor $T_b$ and the switching transistor $T_k$ are n-type transistors, which can simplify a manufacturing process.

In some embodiments, the control electrodes of the compensation transistors $T_b$ in one first demultiplexer 31 receive a same compensation control signal. In some other embodiments, the control electrodes of the compensation transistors $T_b$ in one first demultiplexer 31 receive compensation control signals corresponding to the compensation transistors $T_b$ respectively. In FIG. 2, the control electrodes of the compensation transistors $T_b$ in the first demultiplexer 31 receive compensation control signals corresponding to the compensation transistors $T_b$. As shown in FIG. 2, the control electrode of the compensation transistors $T_b$ in the first branch Z receives a first compensation control signal CKH1', the control electrode of the compensation transistor $T_b$ in the second branch Z receives a second compensation control signal CKH2'.

In the first demultiplexer 31, the branch Z includes the switching transistor $T_k$ and the compensation transistor $T_b$. The control electrode of the switching transistor $T_k$ receives the switching control signal CKH, and the control electrode of the compensation transistor $T_b$ receives the compensation control signal CKH'. That is, one branch Z corresponds to one switching control signal CKH and one compensation control signal CKH'.

Figure 3:
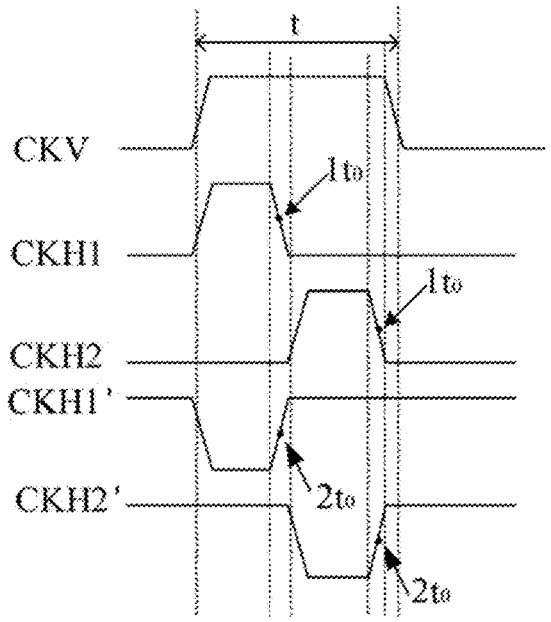
FIG. 3 is a timing sequence of a display panel according to an embodiment of the present disclosure.

FIG. 3 is a timing sequence of a display panel according to an embodiment of the present disclosure. A working process of the first demultiplexer 31 in the embodiment of the present disclosure is described with reference to the timing sequence shown in FIG. 3. FIG. 3 shows that the scanning line 20 provides a scanning signal CKV, and a high level of the scanning signal CKV is an effective level signal for controlling the pixel switch to be turned on. The pixel switch includes a transistor, and the transistor is in an on-state during the period of the effective level signal. The on-state of the transistor includes a state that the transistor is turned on for a degree and a state that the transistor is fully turned on. Therefore, as shown in FIG. 3, the pixel switch has not been turned on at a start moment of a rising edge of the scanning signal CKV, and the pixel switch has been turned off before an end moment of a falling edge of the scanning signal CKV. In the embodiment of the present disclosure, in a period t during which the scanning line 20 provides the effective level signal once, in the branch Z of the first demultiplexer 31, the compensation control signal CKH' received by the compensation transistor $T_b$ has one functional rising edge. The functional rising edge is used to increase the voltage, by coupling, on the data line coupled with the compensation transistor $T_b$. In these embodiments of the present disclosure, the rising edge is understood as a period during which the voltage signal transitions from a low level to a high level, and the falling edge is understood as a period during which the voltage signal transitions from a high level to a low level. Both the rising edge and the falling edge include the start moment and the end moment. As shown in FIG. 3, within the period t during which the scanning line 20 provides the effective level signal once, in the first branch Z of the first demultiplexer 31, the first compensation control signal CKH1' received by the compensation transistor $T_b$ has one functional rising edge; and in the second branch Z of the first demultiplexer 31, the second compensation control signal CKH2' received by the compensation transistor $T_b$ has one functional rising edge.

The working process of the first demultiplexer 31 is described with reference to the timing sequence shown in FIG. 3. When the first switching control signal CKH1 is an effective high level signal (or an enable signal), the switching transistor $T_k$ in the first branch Z is turned on, and the data signal provided by the data signal terminal D is written to the first data line 10-1. Then, the switching transistor $T_k$ in the second branch Z is turned on under the control of the effective high level signal of the second switching control signal CKH2, and the data signal provided by the data signal terminal D is written to the second data line 10-2. In this way, the data signals are sequentially provided, through the demultiplexer, to the m data lines 10 connected to the demultiplexer.

In the working process of the first demultiplexer 31, when the first switching control signal CKH1 is a falling edge, the first switching control signal CKH1 transitions from a high level to a low level to control the switching transistor $T_k$ in the first branch Z to be turned off. The falling edge of the first switching control signal CKH1 includes a start moment and an end moment, the falling edge of the first switching control signal CKH1 also has a first critical moment $\mathbf{1}t_0$, and the first critical moment $\mathbf{1}t_0$ is located between the start moment and the end moment of the falling edge. The switching transistor $T_k$ is gradually turned off from the start moment of the falling edge of the first switching control signal CKH1, and then is fully turned off until the first critical moment $\mathbf{1}t_0$. It can be considered that the switching transistor $T_k$ is turned off (or in other words, the channel of the switching transistor $T_k$ is turned oil) at the first critical moment $\mathbf{1}t_0$, and the switching transistor $T_k$ is turned on for a certain degree, but not fully turned on (or in other words, the channel of the switching transistor $T_k$ is turned on for a certain degree, but not fully turned on) in the period from the start moment to the first critical moment $\mathbf{1}t_0$ of the falling edge of the first switching control signal CKH1. The voltage of the first switching control signal CKH1 is related to the characteristics of the switching transistor $T_k$ at the first critical moment $\mathbf{1}t_0$. There is a capacitance between the gate electrode (control electrode) and the drain electrode (second electrode) of the switching transistor $T_k$. During the period from the start moment to the first critical moment $\mathbf{1}t_0$ of the falling edge of the first switching control signal CKH1, the gate voltage of the switching transistor $T_k$ in the first branch Z transitions from a high level to a low level and the channel of the switching transistor $T_k$ is turned on, in this case, the falling edge of the first switching control signal CKH1 performs coupling on the voltage on the first data line 10-1 in a negative direction, that is, the voltage on the first data line 10-1 is decreased by coupling.

In the embodiment of the present disclosure, the compensation transistor Tb is provided in the first branch Z, the compensation transistor $T_b$ is coupled with the first data line 10-1, and there is also a capacitance between the gate electrode and the drain electrode of the compensation transistor $T_b$, and the drain electrode of the compensation transistor $T_b$ is connected to the first data line 10-1. Within the period t during which the scanning line 20 provides the effective level signal once, the first compensation control signal CKH1' has one functional rising edge. It can be understood that the functional rising edge of the first compensation control signal CKH1' transitioning from a low level to a high level can control the compensation transistor $T_b$ to be turned on. The functional rising edge has a start moment, an end moment, and a second critical moment $\mathbf{2}t_0$. The second critical moment $\mathbf{2}t_0$ is located between the start moment and the end moment of the functional rising edge. The gate voltage of the compensation transistor $T_b$ gradually increases from the start moment of the functional rising edge of the first compensation control signal CKH1'. When the functional rising edge of the first compensation control signal CKH1' reaches the second critical moment, a turn-on voltage of the compensation transistor $T_b$ is reached, and then the compensation transistor $T_b$ is gradually turned on until the compensation transistor $T_b$ is fully turned on at the end moment of the functional rising edge of the first compensation control signal CKH1'. It can be considered that the compensation transistor $T_b$ is turned on for a certain degree, but not fully turned on (or in other words, the channel of the compensation transistor $T_k$ is turned on for a certain degree, but not fully turned on) in the period from the second critical moment $\mathbf{2}t_0$ to the end moment of the functional rising edge of the first compensation control signal CKH1'. It can be considered that the compensation transistor $T_b$ is turned on (or in other words . . . the channel of the compensation transistor $T_k$ is turned on) at the second critical moment $\mathbf{2}t_0$. The voltage of the compensation control signal CKH1' is related to the characteristics of the compensation transistor T) at the second critical moment $\mathbf{2}t_0$. There is a capacitance between the gate electrode (control electrode) and the drain electrode (second electrode) of the compensation transistor $T_b$. During the period from the second critical moment $\mathbf{2}t_0$ to the end moment of the functional rising edge of the first compensation control signal CKH1', the gate voltage of the compensation transistor $T_b$ in the first branch Z transitions from a low level to a high level and the channel of the compensation transistor $T_b$ is turned on, in this case, the functional rising edge of the first compensation control signal CKH1' performs coupling on the voltage on the first data line 10-1 in a positive direction, that is, the voltage on the first data line 10-1 is increased by coupling.

In the embodiments of the present disclosure, during the period t during which the scanning line 20 provides the effective level signal once, the first compensation control signal CKH1' received by the compensation transistor $T_b$ in the first branch Z has one functional rising edge. The functional rising edge of the first compensation control signal CKH1' performs coupling on the first data line 10-1 and can make the voltage on the first data line 10-1 increase. The functional rising edge of the first compensation control signal CKH1' makes the voltage on the first data line 10-1 increase by coupling, to compensate the coupling effect on the first data line 10-1 caused by the falling edge of the first switching control signal CKH1. The falling edge of the first switching control signal CKH1 makes the voltage on the first data line 10-1 decrease by coupling, and the functional rising edge of the first compensation control signal CKH1' makes the voltage on the first data line 10-1 increase by coupling, two coupling effects cancel each other, which can reduce or even eliminate a feed-through voltage on the first data line 10-1 caused by the first switching control signal CKH1, so that a voltage actually written to the first data line 10-1 is substantially the same as a voltage supplied to the first data line 10-1.

Similarly, for the second branch Z, the falling edge of the second switching control signal CKH2 makes the voltage on the second data line 10-2 decrease by coupling, and the functional rising edge of the second compensation control signal CKH2' makes the voltage on the second data line 10-2 increase by coupling, two coupling effects cancel each other, which can reduce or even eliminate a feed-through voltage on the second data line 10-2 caused by the second switching control signal CKH2, so that a voltage actually written to the second data line 10-2 is substantially the same as a voltage supplied to the second data line 10-2.

In the display panel provided by the embodiments of the present disclosure, the compensation transistor $T_b$ is arranged in the branch Z of the first demultiplexer 31 . . . a coupling capacitance exists between the control electrode and the second electrode of the compensation transistor $T_b$, and the compensation transistor $T_b$ is coupled with the data line 10 corresponding to the branch Z, so that signal transition of the compensation control signal CKH' received by the control electrode of the compensation transistor $T_b$ has a coupling effect on the data line 10. It is set that, within the period t during which the scanning line 20 provides the effective level signal once, in the branch Z of the first demultiplexer 31, the compensation control signal CKH' received by the compensation transistor $T_b$ has one functional rising edge, and the functional rising edge is used to increase the voltage, by coupling, on the data line 10 coupled with the compensation transistor $T_b$. Within the period t during which the scanning line 20 provides the effective level signal once, a falling edge of the switching control signal CKH makes the voltage on the data line 10 decrease by coupling, while the functional rising edge of the compensation control signal CKH' makes the voltage on the data line 10 increase by coupling, in this way, two coupling effects cancel each other, thereby reducing or even eliminating a feed-through voltage on the data line 10 caused by the switching control signal CKH, so that a voltage actually written to the data line 10 is substantially the same as a voltage supplied to the data line 10. When the AC driving manner is adopted, it can be ensured that when a uniform common voltage is supplied to the display region, a voltage difference between a positive polarity voltage transmitted on the data line 10 and the common voltage is basically the same as a voltage difference between a negative polarity voltage transmitted on the data line 10 and the common voltage, thereby improving the display flickering phenomenon.

In the embodiment of the present disclosure, both the compensation transistor $T_b$ and the switching transistor $T_k$ have a transistor structure. In the branch Z, the voltage on the data line 10 is decreased by the coupling effect of the switching control signal CKH due to the capacitance between the control electrode and the second electrode of the switching transistor $T_k$. In the embodiment of the present disclosure, the capacitance between the control electrode and the second electrode of the compensation transistor $T_b$ increases the voltage on the data line 10 by coupling. The principles of two coupling effects are the same, and two coupling effects cancel each other and have a good compensation effect. In addition, in the present disclosure, the first electrode and the second electrode of the compensation transistor $T_b$ are short-circuited, so that the compensation transistor $T_b$ has no leakage current to the data line 10, which can avoid voltage misalignment on the data line 10 due to leakage current.

In the embodiment of the present disclosure, within the period t during which the scanning line 20 provides the effective level signal once, the compensation control signal CKH' has one functional rising edge. The end moment of the functional rising edge is located within the period t during which the scanning line 20 provides the effective level signal once, or the end moment of the functional rising edge coincides with the end moment of the period t during which the scanning line 20 provides the effective level signal once. In this way, during the on-time of the pixel row driven by the scanning line 20, the rising edge of the compensation control signal CKH' performs coupling on the data line, so as to ensure that an accurate data voltage is transmitted on the data line and the accurate data voltage is written to the pixels.

In the branch Z, the coupling effect on the data line 10 caused by the falling edge of the switching control signal CKH occurs in the period from the start moment to the first critical moment $\mathbf{1}t_0$ of the falling edge, and the coupling effect on the data line 10 caused by the functional rising edge of the compensation control signal CKH' occurs within the period from the second critical moment $\mathbf{2}t_0$ to the end moment of the functional rising edge. In some embodiments, within the period t during which the scanning line provides the effective level signal once, in the branch Z of the first demultiplexer 31, the end moment of the functional rising edge of the compensation control signal CKH' is not earlier than the first critical moment $\mathbf{1}t_0$. That is to say, for one branch Z, the end moment of the functional rising edge of the compensation control signal CKH' is the same time as the first critical moment $\mathbf{1}t_0$ of the switching control signal CKH, or the end moment of the functional rising edge of the compensation control signal CKH' is later than the first critical moment $\mathbf{1}t_0$ of the switching control signal CKH. When the end moment of the functional rising edge of the compensation control signal CKH' is the same time as the first critical moment $\mathbf{1}t_0$ of the switching control signal CKH, a process that the functional rising edge of the compensation control signal CKH' makes the voltage on the data line 10 increase by coupling and a process that the falling edge of the switching control signal CKH makes the voltage on the data line 10 decrease by coupling ends simultaneously. After the above process, the voltage on the data line 10 may not further decrease due to the falling edge of the switching control signal CKH. In a case that the end moment of the functional rising edge of the compensation control signal CKH' is later than the first critical moment $\mathbf{1}t_0$ of the switching control signal CKH, the process that the falling edge of the switching control signal CKH makes the voltage on the data line 10 decrease by coupling ends firstly, and a process that the functional rising edge of the compensation control signal CKH' makes the voltage on the data line 10 increase by coupling continues, to compensate the voltage on the data line 10. In the embodiment of the present disclosure, the first critical moment $\mathbf{1}t_0$ of the falling edge of the switching control signal CKH is set to be no later than the end moment of the functional rising edge of the compensation control signal CKH', which can ensure that after a process that the functional rising edge of the compensation control signal CKH' makes the voltage on the data line 10 increase, a case that the falling edge of the switching control signal CKH makes the voltage on the data line 10 decrease by coupling no longer occurs.

Figure 8:
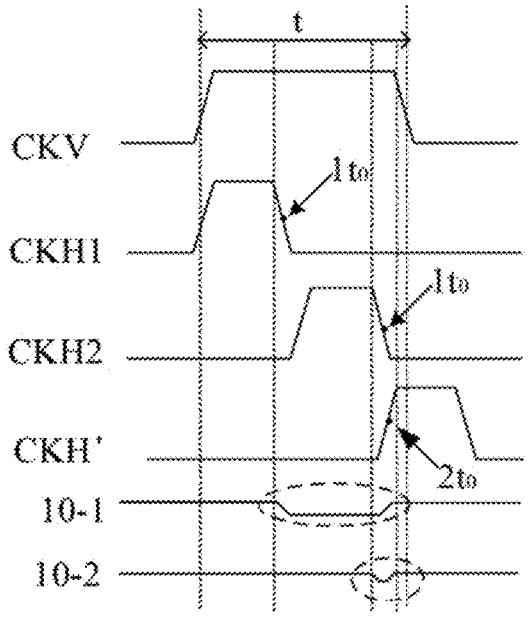
FIG. 8 is a timing sequence of a display panel according to an embodiment of the present disclosure.

It should be noted that, in the embodiment of FIG. 3, only one waveform of the compensation control signal CKH' is shown, and it is shown that the compensation control signal CKH' has one functional rising edge in a period t during which the scanning line 20 provides the effective level signal once. In some embodiments, a waveform cycle of the compensation control signal CKH' may be adjusted or a duty cycle of a high level signal in the waveform cycle of the compensation control signal CKH' may be adjusted. Another waveform of the compensation control signal CKH' is shown in the embodiment of FIG. 8. The waveform of the compensation control signal CKH' in the timing sequence according to the embodiment of the present disclosure is only for schematic representation and is not intended to limit the present disclosure. In the embodiment of the present disclosure, as long as the compensation control signal CKH' has one functional rising edge within the period t during which the scanning line 20 provides the effective level signal once and the end moment of the functional rising edge is not earlier than the first critical moment $1t_0$ of the falling edge of the switching control signal CKH, the functional rising edge of the compensation control signal CKH' can make the voltage on the data line increase by coupling, to compensate the coupling effect on the data line caused by the falling edge of the switching control signal.

In some embodiments, the compensation transistors $T_b$ in branch Z is connected to a corresponding compensation control line. The first demultiplexer 31 includes m branches Z, so m compensation control lines and m switching control lines need to be arranged in the display panel. Taking m=2 as an example, as shown in FIG. 2, the display panel includes two switching control lines ckh, which are a first switching control line ckh1 and a second switching control line ckh2 respectively. The display panel includes two compensation control lines ckh', which are a first compensation control line ckh1' and a second compensation control line ckh2' respectively. It should be noted that, in this embodiment of the present disclosure, the switching control line ckh and the switching control signal provided by the switching control line ckh are represented by the same reference number. For example, the first switching control line ckh1 provides the first switching control signal CKH1. The compensation control line ckh' and the compensation control signal provided by the compensation control line ckh' are represented by the same reference number. For example, the first compensation control line ckh1' provides the first compensation control signal CKH1'.

As shown in FIG. 2, two switching transistors $T_k$ are respectively coupled with two switching control lines ckh. The control electrode of the switching transistor $T_k$ in the first branch Z is coupled with the first switching control line ckh1, and the control electrode of the switching transistor $T_k$ in the second branch Z is coupled with the second switching control line ckh2. The switching control line ckh provides the switching control signal to the switching transistor $T_k$ coupled with the switching control line. Two compensation transistors $T_b$ are respectively coupled with two compensation control lines CKH'. The control electrode of the compensation transistor $T_b$ in the first branch Z is coupled with the first compensation control line ckh1' . . . and the control electrode of the compensation transistor $T_b$ in the second branch Z is coupled with the second compensation control line ckh2'. The compensation control line ckh' provides the compensation control signal to the compensation transistor $T_b$ coupled with the compensation control line. In each branch Z, the compensation control signal CKH' received by the compensation transistor $T_b$ has one functional rising edge within the period t during which the scanning line 20 provides the effective level signal once. In this embodiment, m compensation control lines ckh' are provided, and the compensation transistor $T_b$ in each branch Z in the first demultiplexer 31 is coupled with the compensation control line ckh' corresponding to the branch Z. Within the period during which the scanning line provides the effective level signal once, each branch Z of the first demultiplexer 31 receives the compensation control signal CKH' corresponding to the branch Z. A signal timing of the compensation control line ckh' in each branch Z may be set according to a signal timing of the switching control line ckh corresponding to the branch Z, so as to compensate the coupling effect of the switching control signal on the data line 10 coupled with the branch Z, thereby reducing or even eliminating a feed-through voltage on the data line 10 couple with the branch Z caused by the switching control signal, so that a voltage actually written to the data line 10 is substantially the same as a voltage supplied to the data line 10.

In some embodiments, as shown in the timing sequence shown in FIG. 3, within the period t during which the scanning line 20 provides the effective level signal once, in the first branch Z, one rising edge of the first compensation control signal CKH1' provided to the branch Z by the first compensation control line ckh1' and the falling edge of the first switching control signal CKH1 provided to the branch Z by the first switching control line ckh1 occur simultaneously. In the second branch Z, one functional rising edge of the second compensation control signal CKH2' provided to the branch Z by the second compensation control line ckh2' and the falling edge of the second switching control signal CKH2 provided to the branch Z by the second switching control line ckh2 occur simultaneously. A case where the rising edge and the falling edge occur simultaneously means that the start moment of the functional rising edge and the start moment of the falling edge are the same moment. In this embodiment, within the period t during which the scanning line 20 provides the effective level signal once, in the branch Z of the first demultiplexer 31, the functional rising edge of the compensation control signal provided to the branch Z by the compensation control line ckh' and the falling edge of the switching control signal provided to the branch Z by the switching control line ckh occur simultaneously. In some embodiments, it is set that a difference between a voltage of a high level signal and a voltage of a low level signal in the compensation control signal CKH' is the same as a difference between a voltage of a high level signal and a voltage of a low level signal in the switching control signal CKH, in this way, a timing sequence of the compensation control signal CKH' is easy to implement, and the requirement for the display driving module that generates the compensation control signal CKH' is lower. In addition, the effect that the falling edge of the switching control signal makes the voltage on the data line 10 decrease by coupling and the effect that the rising edge of the compensation control signal makes the voltage on the data line 10 increase by coupling cancel each other, thereby eliminating a feed-through voltage on the data line 10 caused by the switching control signal CKH.

Figure 4:
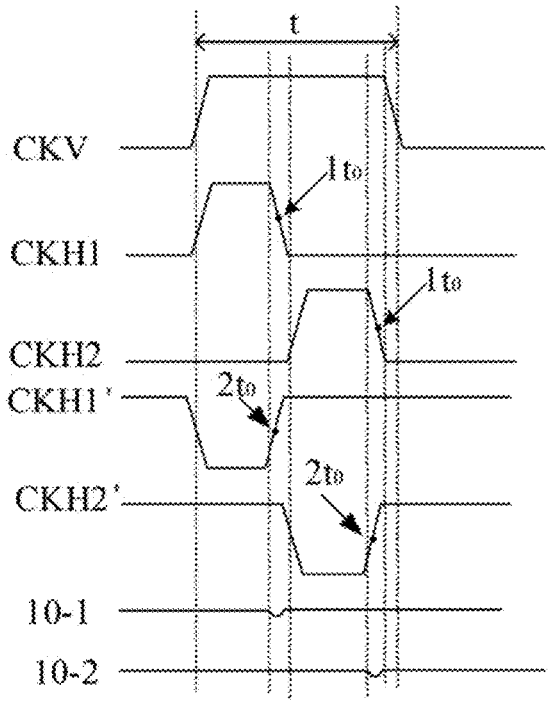
FIG. 4 is a timing sequence of a display panel according to an embodiment of the present disclosure.

In other embodiments, FIG. 4 is a timing sequence of a display panel according to an embodiment of the present disclosure. As shown in FIG. 4, within the period t during which the scanning line provides the effective level signal once, in at least part of the branches Z of the first demultiplexer 31, the end moment of the functional rising edge of the compensation control signal CKH' is earlier than the end moment of the falling edge of the switching control signal CKH. Such setting can correspondingly advance the second critical moment $2t_0$ in the functional rising edge of the compensation control signal CKH'. This embodiment can advance the time of the effect that the functional rising edge of the compensation control signal CKH' makes the voltage on the data line 10 increase by coupling. The effect that the functional rising edge of the compensation control signal CKH' makes the voltage on the data line 10 increase by coupling may start at the moment at which the effect that the falling edge of the switching control signal CKH makes the voltage on the data line 10 decrease by coupling is completed. Alternatively, the coupling effect on the data line 10 caused by the functional rising edge of the compensation control signal CKH' may start before the coupling effect on the data line 10 caused by the falling edge of the switching control signal CKH is completed. Moreover, it can be seen from the timing sequence in FIG. 4 that the difference between the start moments of the two coupling effects is relatively short, which can reduce voltage fluctuation on the first data line 10-1 and the second data line 10-2 and meet strict requirements for charging the data lines 10 in some application scenes.

Figure 5:
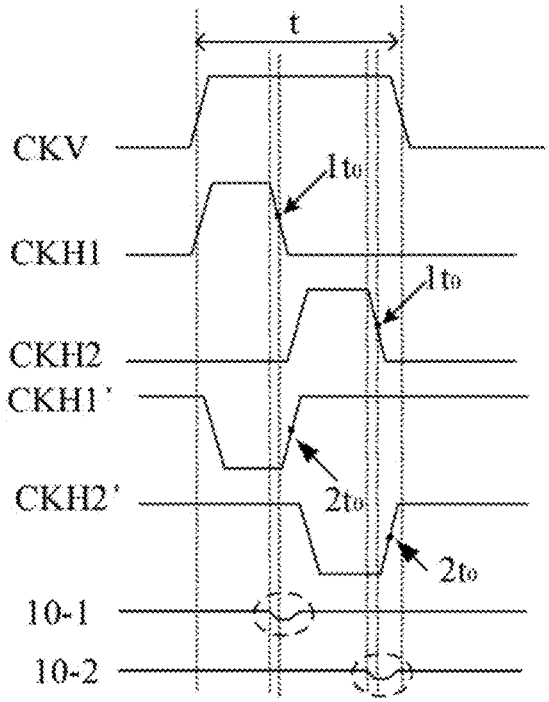
FIG. 5 is a timing sequence of a display panel according to an embodiment of the present disclosure.

In some embodiments, it is set that the second critical moment $2t_0$ in the functional rising edge of the compensation control signal CKH' is not earlier than the first critical moment $1t_0$ in the falling edge of the switching control signal CKH. The second critical moment 2 is at the same moment as the first critical moment $1t_0$ in the falling edge of the switching control signal CKH, or the second critical moment $2t_0$ is before the first critical moment $1t_0$ in the falling edge of the switching control signal CKH. FIG. 5 is a timing sequence of a display panel according to an embodiment of the present disclosure. Still taking m=2 for schematic illustration, the timing sequence provided by the embodiment of FIG. 5 may be applied to the display panel provided by the above-mentioned embodiment of FIG. 2. As shown in FIG. 5, within the period t during which the scanning line 20 provides the effective level signal once, the second critical moment $2t_0$ in the functional rising edge of the first compensation control signal CKH1' corresponding to the first branch Z occurs after the first critical moment $1t_0$ in the falling edge of the first switching control signal CKH1, and the second critical moment $2t_0$ in the functional rising edge of the second compensation control signal CKH2' corresponding to the second branch Z occurs after the first critical moment $1t_0$ in the falling edge of the second switching control signal CKH2. In this embodiment, within the period t during which the scanning line 20 provides the effective level signal once, in the branch Z of the first demultiplexer 31, the second critical moment $2t_0$ in the functional rising edge of the compensation control signal CKH' provided to the branch Z by the compensation control line ckh' occurs after the first critical moment $1t_0$ in the falling edge of the switching control signal CKH provided to the branch Z by the switching control line ckh. It can be seen from the position circled by the dotted circle in FIG. 5 that, the voltage on the data line 10 is first decreased by the coupling of the switching control signal CKH, and then increased by the coupling of the compensation control signal CKH' to compensate the coupling effect of the switching control signal CKH on the data line 10. Two coupling effects cancel each other, thereby reducing or even eliminating a feed-through voltage on the data line 10 caused by the switching control signal, so that a voltage actually written to the data line 10 is substantially the same as a voltage supplied to the data line 10. When the AC driving manner is adopted, it can be ensured that when a uniform common voltage is supplied to the display region, a voltage difference between a positive polarity voltage transmitted on the data line 10 and the common voltage is basically the same as a voltage difference between a negative polarity voltage transmitted on the data line 10 and the common voltage, thereby improving the display flickering phenomenon.

Figure 6:
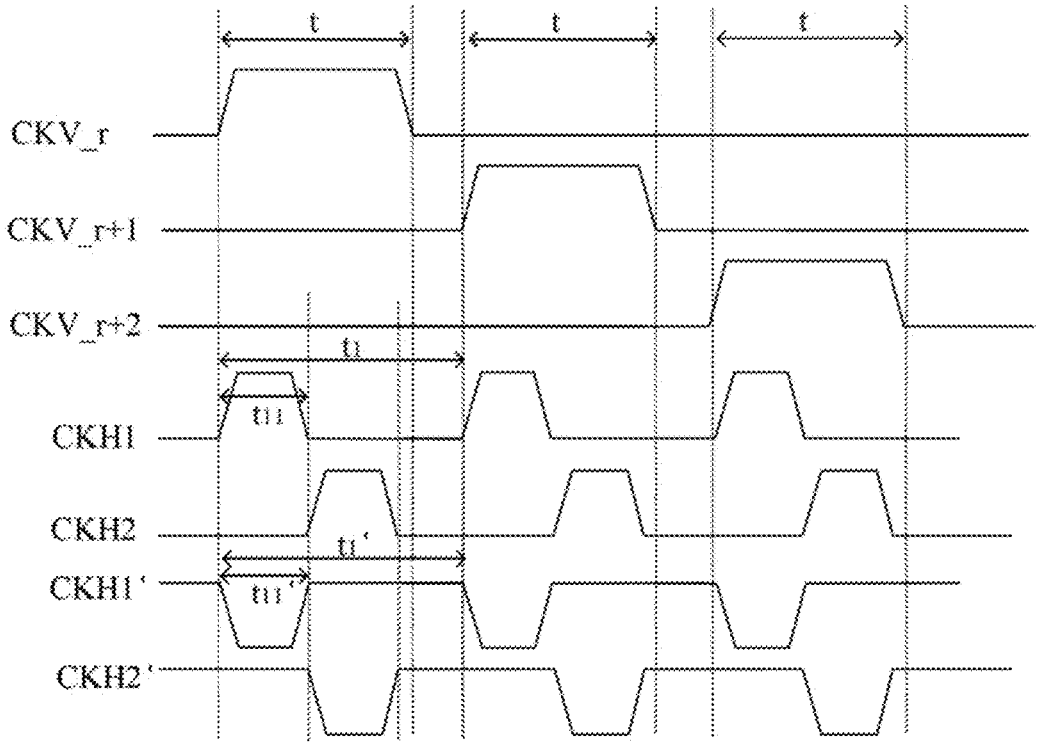
FIG. 6 is a timing sequence of a display panel according to an embodiment of the present disclosure.

In some embodiments, a ratio of a duration of a low level signal in the compensation control signal CKH' to a waveform cycle of the compensation control signal CKH' is equal to a ratio of a duration of a high level signal in the switching control signal CKH to a waveform cycle of the switching control signal CKH. FIG. 6 is a timing sequence of a display panel according to an embodiment of the present disclosure. In FIG. 6, m=2 is taken as an example for description. The timing sequence provided by the embodiment of FIG. 6 may be applied to the display panel provided by the embodiment of FIG. 2 above. FIG. 6 illustrates the scanning signals CKV_r, CKV_r+1 and CKV_r+2 respectively provided by three scanning lines 20 arranged in sequence when one frame of image is displayed. Take the first compensation control signal CKH1' and the first switching control signal CKH1 corresponding to the first branch Z as an example. The cycle of the first compensation control signal CKH1' is t1', and the duration of the low level signal in one cycle t1' of the first compensation control signal CKH1' is t11'. The cycle of the first switching control signal CKH1 is t1 . . . and the duration of the high level signal in one cycle t1 of the first switching control signal CKH1 is t11, where t11'/t1'/t11/t1. In some embodiments, the waveform cycle t1' of the first compensation control signal CKH1' is equal to the waveform cycle t1 of the first switching control signal CKH1. In this embodiment, the compensation control signal CKH' may be set according to a waveform law of the switching control signal CKH, the timing sequence of the compensation control signal CKH' is easy to implement and the requirement for the display driving module that generates the compensation control signal is lower.

It should be noted that, in FIG. 6, the start moment of a rising edge to the start moment of a next rising edge of the switching control signal CKH is taken as one cycle of the switching control signal CKH, and a duration from the start moment of a rising edge to the end moment of the first falling edge after the rising edge of the switching control signal CKH is taken as the duration of the high level signal in one cycle of the switching control signal CKH. In FIG. 6, the start moment of a falling edge to the start moment of a next falling edge of the compensation control signal CKH' is taken as one cycle of the compensation control signal CKH', and a duration from the start moment of a failing edge to the end moment of the first rising edge after the falling edge of the compensation control signal CKH' is taken as the duration of the low level signal in one cycle of the compensation control signal CKH'. In order to clearly illustrate the start moment of the rising edge of the switching control signal CKH and the start moment of the rising edge of the compensation control signal CKH', in FIG. 6, the boundary point of the period t during which the scanning line provides the effective level signal once is drawn to the start moment of the rising edge of the scanning line 20. In fact, the boundary point of the period t during which the scanning line provides the effective level signal once may not coincide with the start moment of the rising edge of the scanning line, and the period t during which the scanning line 20 provides the effective level signal once is understood with reference to relevant description in the embodiment of FIG. 3.

In addition, in FIG. 6, a case, that the end moment of the falling edge of the switching control signal CKH is the same as the end moment of the rising edge of the compensation control signal CKH', is used for illustration. It may be understood from the description in the above embodiments that, in the embodiment of the present disclosure, the coupling effect on the data line 10 caused by the rising edge of the compensation control signal CKH' is used to compensate the coupling on the data line 10 caused by the falling edge of the switching control signal CKH, and it is set that the end moment of the rising edge of the compensation control signal CKH' is not earlier than the first critical moment $1t_0$ of the switching control signal CKH. For the relationship between the end moment of the rising edge of the compensation control signal CKH' and the end moment of the falling edge of the switching control signal CKH, the end moment of the rising edge of the compensation control signal CKH' may be before the end moment of the falling edge of the switching control signal CKH, or the end moment of the rising edge of the compensation control signal CKH' may be the same as the end moment of the falling edge of the switching control signal CKH, or the end moment of the rising edge of the compensation control signal CKH' may be after the end moment of the falling edge of the switching control signal CKH. As shown in the embodiment of FIG. 6, a ratio of a duration of a low level signal in the compensation control signal CKH' to a waveform cycle of the compensation control signal CKH' is equal to a ratio of a duration of a high level signal in the switching control signal CKH to a waveform cycle of the switching control signal CKH.

In other embodiments . . . it may be set that the ratio of the duration of the low level signal in the compensation control signal CKH' to the waveform cycle of the compensation control signal CKH' is not equal to the ratio of the duration of the high level signal in the switching control signal CKH to the waveform cycle of the switching control signal CKH. By adjusting the waveform cycle of the compensation control signal CKH' or adjusting the duty cycle of the high level signal in the waveform cycle of the compensation control signal CKH, it is ensured that within the period t during which the scanning line 20 provides the effective level signal once, the end moment of a functional rising edge of the compensation control signal CKH' is not earlier than the first critical moment $\mathbf{1}t_0$ of the falling edge of the switching control signal CKH.

Figure 7:
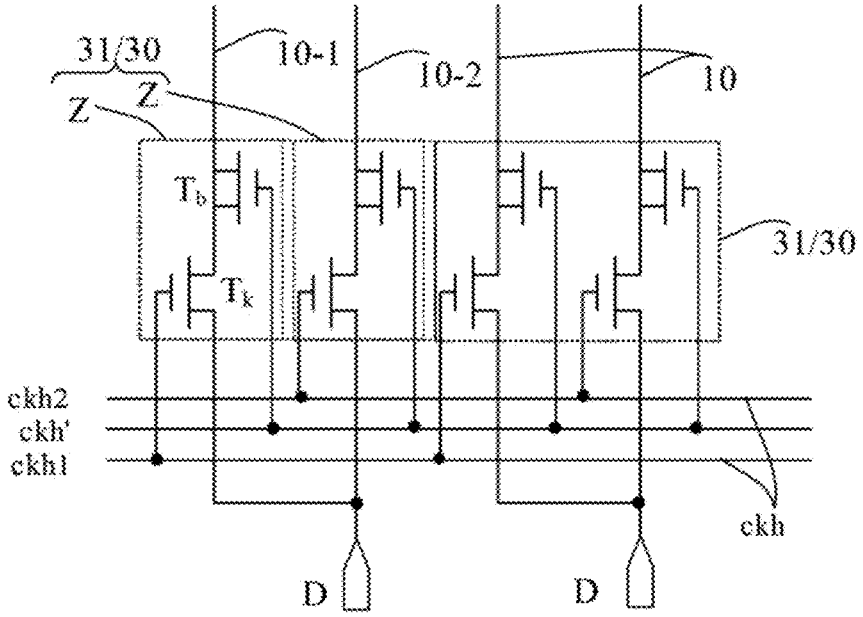
FIG. 7 is a schematic circuit diagram of a display panel according to an embodiment of the present disclosure.

In some embodiments, compensation transistors $T_b$ in the first demultiplexer 31 are connected to the same compensation control line. FIG. 7 is a schematic circuit diagram of a display panel according to an embodiment of the present disclosure, and FIG. 8 is a timing sequence of a display panel according to an embodiment of the present disclosure. Two demultiplexers 30 are shown in FIG. 7. An input terminal of one demultiplexer 30 is coupled with a data signal terminal D. The working process of the first demultiplexer 31 in the embodiment of FIG. 7 is understood with reference to the timing sequence shown in FIG. 8.

As shown in FIG. 7, taking m=2 as an example, the first demultiplexer 31 includes two branches Z. and each branch Z is coupled with one data line 10. The first branch Z is coupled with the first data line 10-1, and the second branch Z is coupled with the second data line 10-2. The first demultiplexer 31 includes two compensation transistors $T_b$, the two compensation transistors $T_b$ are connected to the same compensation control line ckh', and the compensation control line ckh' provides the compensation control signal CKH' to the compensation transistors $T_b$ coupled with the compensation control line ckh'. The display panel includes two switching control lines ckh, which are a first switching control line CKH1 and a second switching control line ckh2 respectively. In the first demultiplexer 31, the two switching transistors $T_k$ are correspondingly coupled with the two switching control lines ckh. The control electrode of the switching transistors $T_k$ in the first branch Z is coupled with the first switching control line ckh1, the control electrode of the switching transistor $T_k$ in the second branch Z is coupled with the second switching control line ckh2, and the switching control line ckh provides the switching control signal to the switching transistor $T_k$ coupled with the switching control line ckh. In this embodiment, the compensation transistors $T_k$ in the first demultiplexer 31 are connected to the same compensation control line ckh', which can reduce the number of compensation control lines, save a wiring space of the non-display region NA, and help the frame narrowing.

In the embodiment shown in FIG. 7, the control electrodes of the compensation transistors $T_b$ in branches Z of the first demultiplexer 31 receive the same compensation control signal CKH', when the voltage jumps on the compensation control signal CKH', coupling effects on the data line 10 caused by the control electrodes of the compensation transistors $T_b$ in the branches Z occur simultaneously.

Referring to FIG. 8, the working process of one first demultiplexer 31 is described. When the first switching control signal CKH1 is an effective high level signal . . . the switching transistor $T_k$ in the first branch Z is turned on, and the data signal provided by the data signal terminal D is written to the first data line 10-1. Then, the switching transistor $T_k$ in the second branch Z is turned on under the control of the effective high level signal of the second switching control signal CKH2, and the data signal provided by the data signal terminal D is written to the second data line 10-2. In this way, the data signals are sequentially provided, through the demultiplexer, to the m data lines 10 connected to the demultiplexer.

Within the period t during which the scanning line 20 provides the effective level signal once, the first switching control signal CKH1 received by the switching transistor $T_k$ in the first branch Z has one falling edge first, and at this time, the switching transistor $T_k$ in the first branch Z is controlled to be turned off. As shown in the timing sequence corresponding to the first data line 10-1 in FIG. 8, the falling edge of the first switching control signal CKH1 makes the voltage on the first data line 10-1 decrease by coupling. The falling edge of the first switching control signal CKH1 has a first critical moment $\mathbf{1}t_0$. In the first branch Z, the end moment of the functional rising edge of the compensation control signal CKH' received by the compensation transistor $T_b$ is not earlier than the first critical moment $\mathbf{1}t_0$ of the falling edge of the first switching control signal CKH1 received by the switching transistor $T_k$. The rising edge of the compensation control signal CKH' has a second critical moment $\mathbf{2}t_0$, and the compensation control signal CKH' makes the voltage on the first data line 10-1 increase by coupling during the period from the second critical moment $\mathbf{2}t_0$ of the functional rising edge to the end moment of the functional rising edge of the compensation control signal CKH'. Within the period t during which the scanning line 20 provides the effective level signal once, the second switching control signal CKH2 received by the switching transistor $T_k$ in the second branch Z has one falling edge, and at this time, the switching transistor $T_k$ in the second branch Z is controlled to be turned off. As shown in the timing sequence corresponding to the second data line 10-2 in FIG. 8, the falling edge of the second switching control signal CKH2 makes the voltage on the second data line 10-2 decrease by coupling. In the second branch Z, the end moment of the functional rising edge of the compensation control signal CKH' received by the compensation transistor $T_b$ is not earlier than the first critical moment $\mathbf{1}t_0$ of the falling edge of the second switching control signal CKH2 received by the switching transistor $T_k$. The compensation control signal CKH' makes the voltage on the second data line 10-2 increase by coupling during the period from the second critical moment $\mathbf{2}t_0$ of the functional rising edge to the end moment of the functional rising edge of the compensation control signal CKH'.

In this embodiment, the control electrodes of the compensation transistors $T_b$ in the branches Z of the first demultiplexer 31 are coupled with the same the compensation control signal line ckh'. Within the period t during which the scanning line 20 provides the effective level signal once, the rising edge of the compensation control signal CKH' simultaneously performs coupling on the data lines 10 coupled with the branches, makes the voltage on the data lines 10 coupled with the branches increase, to compensate the coupling effect on the data line caused by the falling edge of the switching control signal CKH in each branch Z. Within the period t during which the scanning line 20 provides the effective level signal once, a falling edge of the switching control signal CKH makes the voltage on the data line 10 decrease by coupling, while the rising edge of the compensation control signal CKH' makes the voltage on the data line 10 increase by coupling, in this way, two coupling effects cancel each other, thereby reducing or even eliminating a feed-through voltage on the data line 10 caused by the switching control signal CKH, so that a voltage actually written to the data line is substantially the same as a voltage supplied to the data line 10. When the AC driving manner is adopted, it can be ensured that when a uniform common voltage is supplied to the display region, a voltage difference between a positive polarity voltage transmitted on the data line 10 and the common voltage is basically the same as a voltage difference between a negative polarity voltage transmitted on the data line 10 and the common voltage, thereby improving the display flickering phenomenon.

In some embodiments, the control electrodes of the compensation transistors $T_b$ in the branches Z of the first demultiplexer 31 receive the same compensation control signal CKH', it is set that the second critical moment $2t_0$ of the functional rising edge of the compensation control signal CKH' is not earlier than the first critical moment $1t_0$ of the last falling edge of the m switching control signals CKH received by the first demultiplexer 31. Then, after the voltage on the data line 10 coupled with each branch Z is decreased by coupling, the functional rising edge of the compensation control signal CKH' simultaneously performs coupling on the data lines 10 coupled with the branches Z to make the voltage on the data line 10 coupled with each branch Z increase coupling, to compensate the coupling effect on the data line caused by the falling edge of the switching control signal CKH in each branch Z.

In some embodiments, taking m=2 as an example, as shown in FIG. 8, within the period t during which the scanning line 20 provides the effective level signal once, the first branch Z is turned on firstly, and the second branch Z is turned on secondly. The first control signal CKH1 provided by the first switching control line ckh1 corresponding to the first branch Z has one falling edge firstly, and then the second control signal CKH2 provided by the second switching control line ckh2 corresponding to the second branch Z has one falling edge, and the end moment of the functional rising edge of the compensation control signal CKH' is not earlier than the first critical moment $1t_0$ of the falling edge of the second control signal CKH2. That is to say, in the first demultiplexer 31, the end moment of a functional rising edge of the compensation control signal CKH' provided to the branch Z by the compensation control line ckh' is not earlier than the first critical moment $1t_0$ of the last falling edge of the switching control signals CKH provided to the branches Z by the m switching control lines ckh. In this embodiment, the functional rising edge of the compensation control line ckh' may be at the same moment as the first critical moment $1t_0$ of the falling edge of the switching control signal CKH corresponding to the branch Z that is turned on last in the m branches Z. Alternatively, the end moment of the functional rising edge of the compensation control line ckh' may occur after the first critical moment $1t_0$ of the falling edge of the switching control signal CKH corresponding to the branch Z that is turned on last among the m branches Z. In this way, it can be ensured that the voltage on the data line 10 coupled with each branch Z is increased by the rising edge of one compensation control signal CKH', so as to compensate the coupling effect on the data line 10 caused by the falling edge of the switching control signal CKH in each branch Z.

Figure 9:
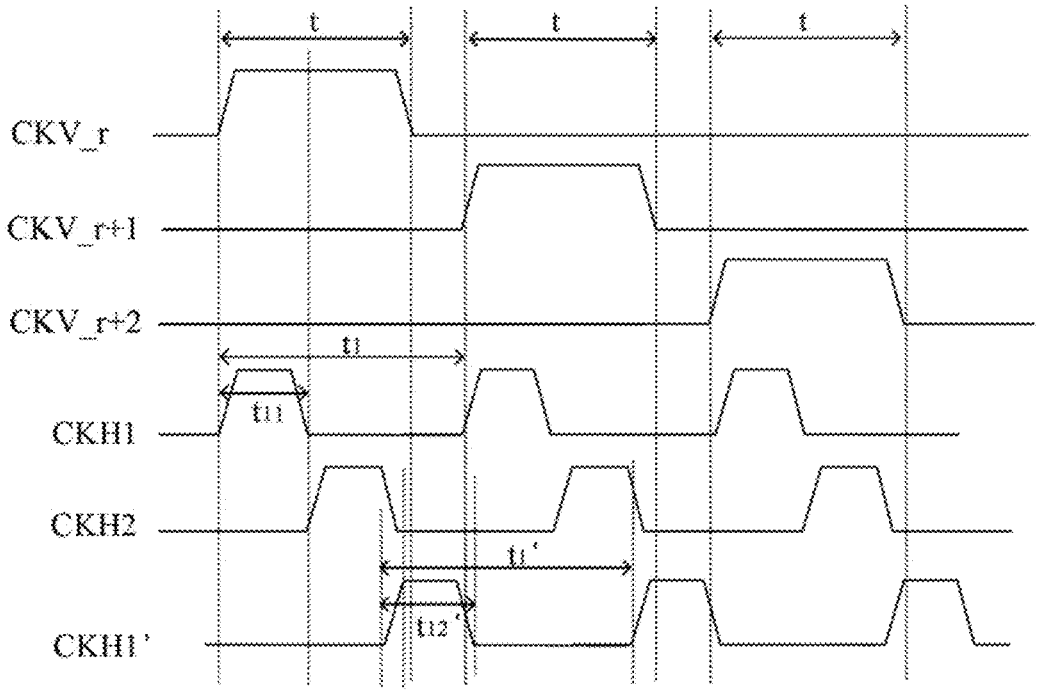
FIG. 9 is a timing sequence of a display panel according to an embodiment of the present disclosure.

In some embodiments, FIG. 9 is a timing sequence of a display panel according to an embodiment of the present disclosure. In FIG. 9, m=2 is taken as an example for description. The timing sequence provided by the embodiment of FIG. 9 may be applied to the display panel provided by the embodiment of FIG. 7 above. FIG. 9 illustrates the scanning signals CKV_r, CKV_r+1 and CKV_r+2 respectively provided by three scanning lines 20 arranged in sequence when one frame of image is displayed. The cycle of the first switching control signal CKH1 is the same as the cycle of the second switching control signal CKH2. The description is made by comparing the compensation control signal CKH' with the first switching control signal CKH1. The cycle of the first compensation control signal CKH1' is t1' . . . and the duration of the high level signal in one cycle t1' of the first compensation control signal CKH1' is t12'. The cycle of the first switching control signal CKH1 is t1, and the duration of the high level signal in one cycle Il of the first switching control signal CKH1 is t11, where t12'/t1'=t11/t1. In some embodiments, the waveform cycle t1' of the first compensation control signal CKH1' is equal to the waveform cycle t1 of the first switching control signal CKH1. In this embodiment, it may be set that a ratio of the duration of the high level signal in the compensation control signal CKH' to the waveform cycle of the compensation control signal CKH' is equal to a ratio of the duration of the high level signal in the switching control signal CKH to the waveform cycle of the switching control signal CKH. It may be set that a waveform law of the compensation control signal CKH' is the same as a waveform law of the switching control signal CKH . . . the timing sequence of the compensation control signal CKH' is easy to implement and the requirement for the display driving module that generates the compensation control signal is lower.

It should be noted that, in FIG. 9, the start moment of a rising edge to the start moment of a next rising edge of the switching control signal CKH is taken as one cycle of the switching control signal CKH, and a duration from the start moment of a rising edge to the end moment of the first falling edge after the rising edge of the switching control signal CKH is taken as the duration of the high level signal in one cycle of the switching control signal CKH. In FIG. 9, the start moment of a rising edge to the start moment of a next rising edge of the compensation control signal CKH' is taken as one cycle of the compensation control signal CKH', and a duration from the start moment of a rising edge to the end moment of the first falling edge after the rising edge of the compensation control signal CKH' is taken as the duration of the high level signal in one cycle of the compensation control signal CKH'. In order to clearly illustrate the start moment of the rising edge of the switching control signal CKH1, in FIG. 9, the boundary point of the period t during which the scanning line 20 provides the effective level signal once is drawn to the start moment of the rising edge of the scanning line 20. In fact, the boundary point of the period t during which the scanning line provides the effective level signal once may not coincide with the start moment of the rising edge of the scanning line, and the period t during which the scanning line provides the effective level signal once is understood with reference to relevant description in the embodiment of FIG. 3.

In addition, in FIG. 9, the end moment of the rising edge of the compensation control signal CKH' is later than the end moment of the falling edge of the second switching control signal CKH2, is used for illustration. It may be understood from the description in the above embodiments that, in the embodiment of the present disclosure, the coupling effect on the data line 10 caused by the functional rising edge of the compensation control signal CKH' is used to compensate the coupling on the data line 10 caused by the falling edge of the switching control signal CKH. When the compensation transistors in the m branches Z receive the same compensation control signal, it is set that the end moment of the functional rising edge of the compensation control signal CKH' is not earlier than the first critical moment $1t_0$ of the last falling edge of the m switching control signals CKH. For the embodiment of FIG. 9, as long as the end moment of the functional rising edge of the compensation control signal CKH' is not earlier than the first critical moment $1t_0$ in the falling edge of the second switching control signal CKH2. The first critical moment $1t_0$ is earlier than the end moment of the falling edge of the second switching control signal CKH2. For a relationship between the end moment of the functional rising edge of the compensation control signal CKH' and the end moment of the falling edge of the second switching control signal CKH2, the end moment of the functional rising edge of the compensation control signal CKH' may be before the end moment of the falling edge of the second switching control signal CKH2, or the end moment of the functional rising edge of the compensation control signal CKH' may be the same as the end moment of the falling edge of the second switching control signal CKH2, or the end moment of the functional rising edge of the compensation control signal CKH' may be after the end moment of the falling edge of the second switching control signal CKH2.

As shown in the embodiment of FIG. 9, a ratio of a duration of a high level signal in the compensation control signal CKH' to a waveform cycle of the compensation control signal CKH' is equal to a ratio of a duration of a high level signal in the switching control signal CKH to a waveform cycle of the switching control signal CKH.

In other embodiments, it may be set that the ratio of the duration of the high level signal in the compensation control signal CKH' to the waveform cycle of the compensation control signal CKH' is not equal to the ratio of the duration of the high level signal in the switching control signal CKH to the waveform cycle of the switching control signal CKH. By adjusting the waveform cycle of the compensation control signal CKH' or adjusting the duty cycle of the high level signal in the waveform cycle of the compensation control signal CKH', it is ensured that within the period t during which the scanning line 20 provides the effective level signal once, the end moment of a functional rising edge of the compensation control signal CKH' is not earlier than the first critical moment $1t_0$ of the falling edge of the switching control signal CKH.

Figure 10:
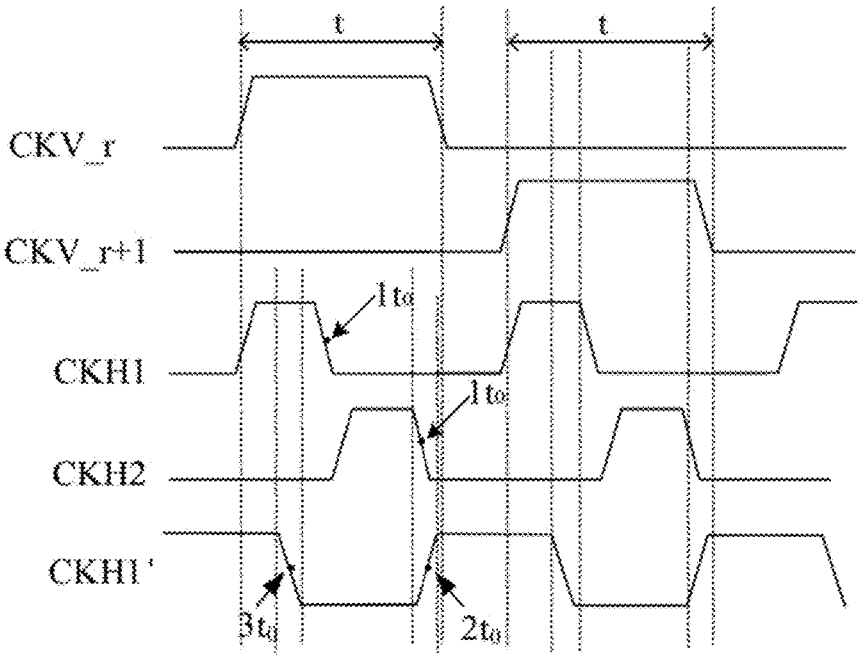
FIG. 10 is a timing sequence of a display panel according to an embodiment of the present disclosure.

In some embodiments, FIG. 10 is a timing sequence of a display panel according to an embodiment of the present disclosure. The timing sequence provided by the embodiment of FIG. 10 may be applied to the display panel provided by the embodiment of FIG. 7 above. FIG. 10 illustrates the scanning signals CKV_r . . . and CKV_r+1 respectively provided by two scanning lines 20 arranged in sequence when one frame of image is displayed. As shown in FIG. 10, within the period t during which the scanning line 20 provides the effective level signal once, the first branch Z is turned on first, and the second branch Z is turned on secondly. The first control signal CKH1 provided by the first switching control line ckh1 corresponding to the first branch Z has one falling edge firstly, and then the second control signal CKH2 provided by the second switching control line ckh2 corresponding to the second branch Z has one falling edge, and the end moment of the rising edge of the compensation control signal CKH' is not earlier than the first critical moment $1t_0$ of the falling edge of the second control signal CKH2. Within the period t during which the scanning line 20 provides the effective level signal once, the compensation control signal CKH' has one functional rising edge and one falling edge, the falling edge of the compensation control signal CKH' has a third critical moment $3t_0$. The third critical moment $3t_0$ is located between the start moment and the end moment of the falling edge of the compensation control signal CKH'. The compensation transistor $T_b$ is turned off at the third critical moment $3t_0$. The third critical moment $3t_0$ is not later than the first critical moment $1t_0$ of the first falling edge of the m switching control signals CKH received by the first demultiplexer 31. During the period from the start moment to the third critical time $3t_0$ of the falling edge of the compensation control signal CKH', the compensation transistor $T_b$ is turned on, the falling edge of the compensation control signal CKH' during this period makes the voltage on the data line 10 in the branch where the compensation transistor $T_b$ is located decrease by coupling. The setting in the embodiment of the present disclosure can avoid that, within the period t during which the scanning line 20 provides the effective level signal once, the falling edge of the compensation control signal CKH' makes the voltage on the data line decrease by coupling, which results in a case that the feed-through voltage is generated on the data line 10 again.

In some embodiments, within the period t during which the scanning line 20 provides the effective level signal once, the compensation control signal CKH' has no falling edge after the functional rising edge. The setting can ensure that the functional rising edge of the compensation control signal CKH' makes the voltage on the data line 10 increase by coupling, to offset the effect that the falling edge of the switching control signal CKH makes the voltage on the data line 10 decrease by coupling, thereby reducing or even eliminating a feed-through voltage on the data line caused by the switching control signal. In addition, it is avoided that the falling edge after the functional rising edge of the compensation control signal CKH' makes the voltage on the data line 10 decrease by coupling again.

In some embodiments, the compensation transistor $T_b$ and the switching transistor $T_k$ in the first demultiplexer 31 are both n-type transistors, and a width to length ratio of the switching transistor $T_k$ is the same as a width to length ratio of the compensation transistor $T_b$. In this embodiment, the compensation transistor $T_b$ and the switching transistor $T_k$ have the same characteristics, and the capacitance between the control electrode and the second electrode of the compensation transistor $T_b$ is substantially the same as the capacitance between the control electrode and the second electrode of the switching transistor $T_k$. In the branch Z, the capacitance between the control electrode and the second electrode of the switching transistor $T_k$ makes the voltage on the data line 10 decrease due to the coupling of the control electrode of the compensation transistor $T_k$. In the embodiment of the disclosure, the capacitance between the control electrode and the second electrode of the compensation transistor $T_b$ makes the voltage on the data line 10 increase. The principles of two coupling effects are the same, and two coupling effects cancel each other and have a good compensation effect, thereby reducing or even eliminating a feed-through voltage on the data line caused by the switching control signal, so that a voltage actually written to the data line is substantially the same as a voltage supplied to the data line 10.

Figure 11:
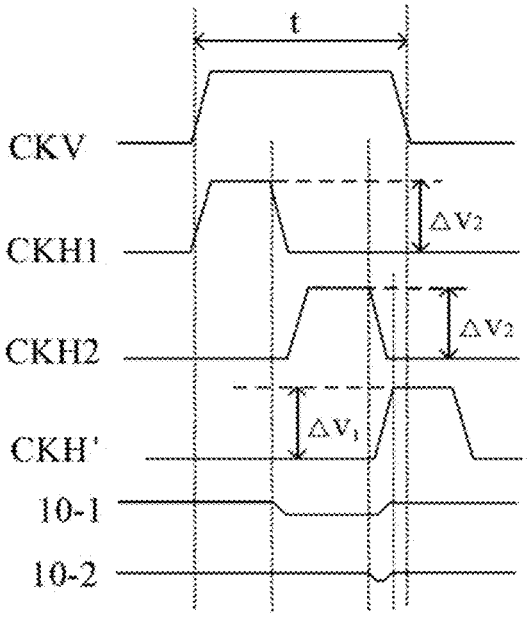
FIG. 11 is a timing sequence of a display panel according to an embodiment of the present disclosure.

In some embodiments, FIG. 1I is a timing sequence of a display panel according to an embodiment of the present disclosure. As shown in FIG. 11, a difference between a voltage of a high level signal and a voltage of a low level signal in the compensation control signal CKH' is $\Delta V_1$, and a difference between a voltage of a high level signal and a voltage of a low level signal in the switching control signal CKH is $\Delta V_2$, where $\Delta V_1=\Delta V_2$. In some embodiments, the voltage of the high level signal in the compensation control signal CKH' is equal to the voltage of the high level signal in the switching control signal CKH, and the voltage of the low level signal in the compensation control signal CKH' is equal to the voltage of the low level signal in the switching control signal CKH. The compensation control signal CKH' is easy to implement, and the requirement for the display driving module is lower. In addition, in a case that the width to length ratio of the switching transistor $T_k$ is the same as the width to length ratio of the compensation transistor $T_b$, setting $\Delta V_1=\Delta V_2$ can realize that the effect that the falling edge of the switching control signal makes the voltage on the data line 10 decrease by coupling and the effect that the functional rising edge of the compensation control signal makes the voltage on the data line 10 increase by coupling cancel each other, thereby eliminating a feed-through voltage on the data line 10 caused by the switching control signal CKH.

In addition, it should be noted that, as shown in FIG. 11, the gate electrodes of the m compensation transistors in the first demultiplexer 31 receive the same compensation control signal CKH'. The end moment of the functional rising edge of the compensation control signal CKH' is later than the end moment of the falling edge of the second switching control signal CKH2. In the embodiment of the present disclosure, the coupling effect on the data line 10 caused by the functional rising edge of the compensation control signal CKH' is used to compensate the coupling on the data line 10 caused by the falling edge of the switching control signal CKH. When the compensation transistors in the m branches Z receive the same compensation control signal, it is set that the end moment of the functional rising edge of the compensation control signal CKH' is not earlier than the first critical moment $1t_0$ of the last falling edge of the m switching control signals CKH. For the embodiment of FIG. 11, as long as the end moment of the rising edge of the compensation control signal CKH' is not earlier than the first critical moment $1t_0$ in the falling edge of the second switching control signal CKH2. The first critical moment $1t_0$ is earlier than the end moment of the falling edge of the second switching control signal CKH2. For a relationship between the end moment of the functional rising edge of the compensation control signal CKH' and the end moment of the falling edge of the second switching control signal CKH2, the end moment of the functional rising edge of the compensation control signal CKH' may be before the end moment of the falling edge of the second switching control signal CKH2, or the end moment of the functional rising edge of the compensation control signal CKH' may be the same as the end moment of the falling edge of the second switching control signal CKH2, or the end moment of the functional rising edge of the compensation control signal CKH' may be after the end moment of the falling edge of the second switching control signal CKH2.

Figure 12:
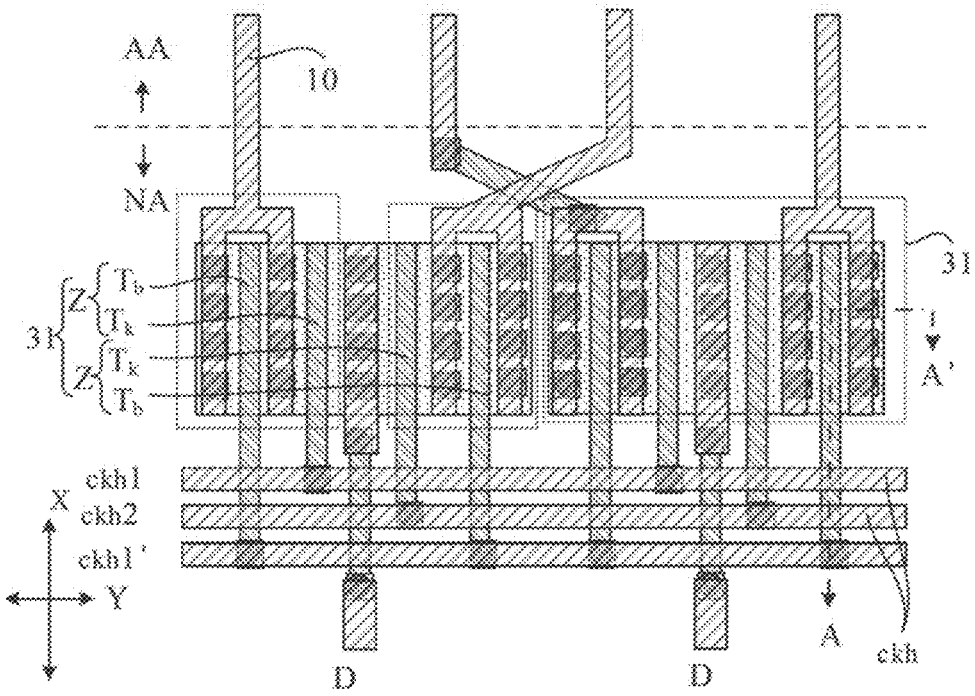
FIG. 12 is a partial schematic diagram of a display panel according to an embodiment of the present disclosure.
Figure 13:
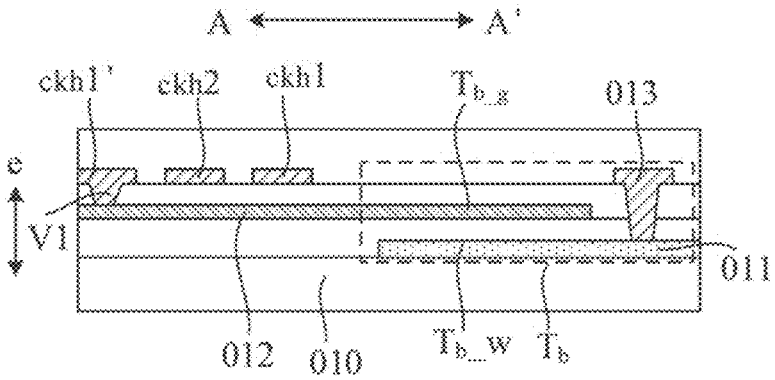
FIG. 13 is a schematic cross-sectional view along tangent line AA' shown in FIG. 12.
Figure 17:
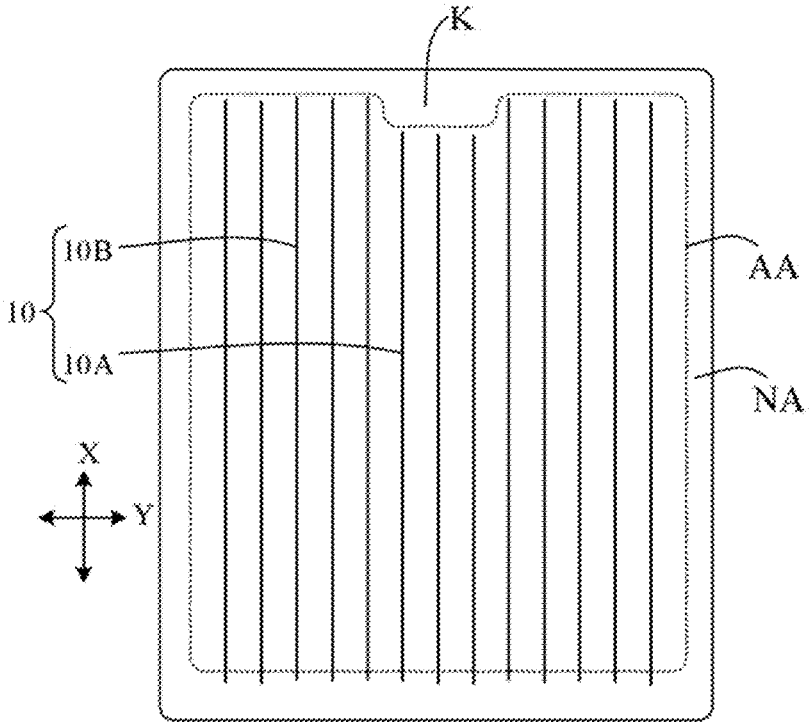
FIG. 17 is a schematic diagram of a display panel according to an embodiment of the present disclosure.

In some embodiments, FIG. 12 is a partial schematic diagram of a display panel according to an embodiment of the present disclosure. FIG. 13 is a schematic cross-sectional view along tangent line AA shown in FIG. 12. In FIG. 12, the compensation transistors $T_b$ in the first demultiplexer 31 are connected to the same compensation control line ckh'. It can be understood with reference to the schematic circuit diagram of the embodiment of FIG. 7. As shown in FIG. 17, the data lines 10 extends along a first direction X; in the branch Z of the first demultiplexer 31, the compensation transistor $T_b$ and the switching transistor $T_k$ are arranged along the second direction Y, and the second direction Y and the first direction X intersect.

Referring to FIG. 13, the display panel includes a substrate 010 and a semiconductor layer 011, a first metal layer 012 and a second metal layer 013 on one side of the substrate 010. The compensation transistor $T_b$ includes an active layer, a gate electrode, a source electrode and a drain electrode. The active layer of the compensation transistor $T_b$ is located in the semiconductor layer 011, the gate electrode of the compensation transistor $T_b$ is located in the first metal layer 012, and the source electrode and the drain electrode of the compensation transistor $T_b$ are located in the second metal layer 013. The source electrode and the drain electrode of the compensation transistor $T_b$ are the first electrode and the second electrode of the compensation transistor $T_b$ respectively. The active layer of the compensation transistor $T_b$ includes a channel, and the gate electrode $T_b$_g of the compensation transistor $T_b$ is illustrated in FIG. 13. In the direction e perpendicular to a plane of the substrate 010, a portion of the semiconductor layer 011 that overlaps with the gate electrode $T_b$_g of the compensation transistor $T_k$ is the channel $T_b$_w of the compensation transistor $T_b$. Referring to FIG. 12, a length of the channel $T_b$_w of the compensation transistor $T_b$ in the first direction X is a length of the channel $T_b$_w, and a length of the channel $T_b$_w of the compensation transistor $T_b$ in the second direction Y is a width of the channel $T_b$_w. It can be understood that the width to length ratio of the compensation transistor $T_b$ is the ratio of the width to the length of the channel $T_b$_w of the compensation transistor $T_b$. In the embodiment of the present disclosure, the compensation transistor $T_b$ and the switching transistor $T_k$ are arranged along the second direction Y, which is easy to realize, when manufacturing the transistors, that the width to length ratio of the compensation transistor $T_b$ is equal to the width to length ratio of the switching transistor $T_k$.

In addition, it can be seen from FIG. 13 that in the embodiment of the present disclosure, the compensation control line ckh' and the switching control line ckh are both located in the second metal layer 013. The gate electrode $T_b$_g of the compensation transistor $T_b$ is coupled to the compensation control line ckh' through a via hole V1 penetrating an insulating layer.

Figure 14:
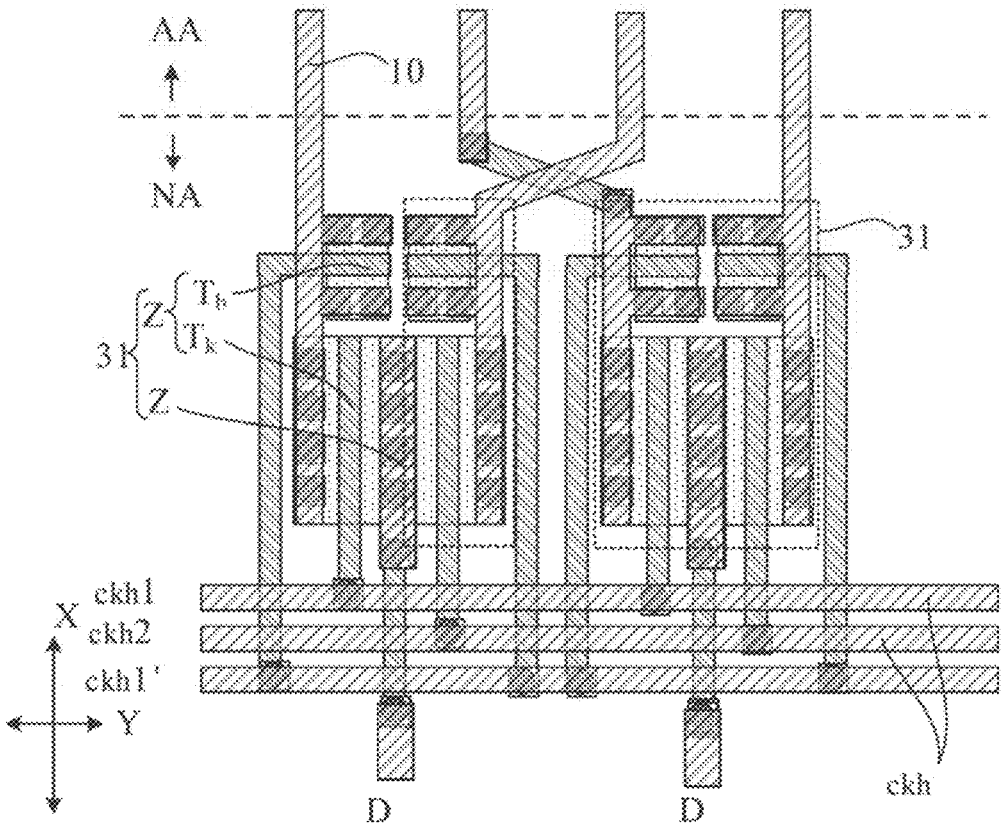
FIG. 14 is a partial schematic diagram of a display panel according to an embodiment of the present disclosure.

In other embodiments, FIG. 14 is a partial schematic diagram of a display panel according to an embodiment of the present disclosure. As shown in FIG. 14, a channel area of the compensation transistor $T_b$ is smaller than a channel area of the switching transistor $T_k$. The channel area of the transistor is a product of a channel length and a channel width. For the concept of the channel of the transistor, reference may be made to the related descriptions in the embodiments of FIG. 12 and FIG. 13. In the embodiment of FIG. 14, a length direction of the channel of the compensation transistor $T_b$ is the first direction X, and a length direction of the channel of the switching transistor $T_k$ is the second direction Y. In this embodiment, a device size of the compensation transistor $T_b$ is smaller than a device size of the switching transistor $T_k$, so that an area occupied by the compensation transistor $T_b$ is small, the space of the non-display region NA can be saved, and the requirement of high PPI (Pixels Per Inch) can be met.

In FIG. 14, the compensation transistors $T_b$ in the first demultiplexer 31 are connected to the same compensation control line ckh', which may be understood in conjunction with the schematic circuit diagram of the embodiment in FIG. 7. The wiring diagram, in which each compensation transistor $T_b$ in the first demultiplexer 31 is connected to a corresponding compensation control line ckh' in the embodiment of FIG. 2, may be understood with reference to FIG. 14, and details are not repeated here.

As shown in FIG. 14, the data lines 10 extend along the first direction X; in the branch Z of the first demultiplexer 31, the compensation transistor $T_b$ is located a side of the switching transistor $T_k$ close to the display region AA in the second direction Y. The first direction X and the second direction Y intersect. This setting can reduce the width occupied by the first demultiplexer 31 in the second direction Y. Furthermore, it is set that, the channel area of the compensation transistor $T_b$ is smaller than the channel area of the switching transistor $T_k$, which can save the space of the non-display region NA and satisfy the requirement of high PPI.

Figure 15:
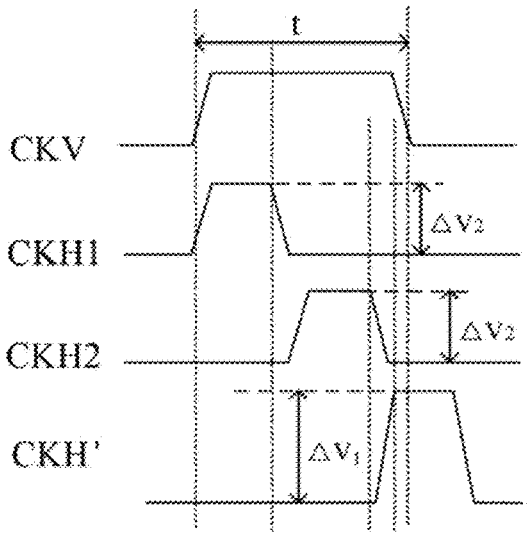
FIG. 15 is a timing sequence of a display panel provided by an embodiment of the present disclosure.

FIG. 15 is a timing sequence of a display panel provided by an embodiment of the present disclosure. The timing sequence provided in FIG. 15 may be used to drive the display panel provided in the embodiment of FIG. 14. As shown in FIG. 15, a difference between a voltage of a high level signal and a voltage of a low level signal in the compensation control signal CKH' is $\Delta V_1$, and a difference between a voltage of a high level signal and a voltage of a low level signal in the switching control signal CKH is $\Delta V_2$, where $\Delta V_1 > \Delta V_2$. In the embodiment of FIG. 14, the channel area of the compensation transistor $T_b$ is smaller than the channel area of the switching transistor $T_k$, which reduces the area occupied by the compensation transistor $T_b$, and also makes device characteristics of the compensation transistor $T_b$ be different from those of the switching transistor $T_k$. The capacitance between the control electrode and the second electrode of the compensation transistor $T_b$ is less than the capacitance between the control electrode and the second electrode of the switching transistor $T_k$, that is, the capacitance between the gate electrode and the drain electrode of the compensation transistor $T_b$ is less than the capacitance between the gate electrode and the drain electrode of the switching transistor $T_k$. In this embodiment, setting $\Delta V_1 > \Delta V_2$ can make the voltage difference between the high level signal and the low level signal in the compensation control signal CKH' increase, so that a degree that the functional rising edge of the compensation control signal CKH' makes the voltage on the data line 10 increase by coupling is consistent with a degree that the falling edge of the switching control signal CKH makes the voltage on the data line 10 decrease by coupling. Two coupling effects cancel each other, thereby eliminating a feed-through voltage on the data line caused by the switching control signal, so that a voltage actually written to the data line 10 is substantially the same as a voltage supplied to the data line 10.

As shown in FIG. 15, the gate electrodes of the m compensation transistors in the first demultiplexer 31 receive the same compensation control signal CKH'. The end moment of the functional rising edge of the compensation control signal CKH' is later than the end moment of the falling edge of the second switching control signal CKH2. In the embodiment of the present disclosure, the coupling effect on the data line 10 caused by the functional rising edge of the compensation control signal CKH' is used to compensate the coupling on the data line 10 caused by the falling edge of the switching control signal CKH. When the compensation transistors in the m branches Z receive the same compensation control signal, it is set that the end moment of the functional rising edge of the compensation control signal CKH' is not earlier than the first critical moment $1t_0$ of the last falling edge of the m switching control signals CKH. For the embodiment of FIG. 15, as long as the end moment of the rising edge of the compensation control signal CKH' is not earlier than the first critical moment $1t_0$ in the falling edge of the second switching control signal CKH2. The first critical moment $1t_0$ is earlier than the end moment of the falling edge of the second switching control signal CKH2. For a relationship between the end moment of the functional rising edge of the compensation control signal CKH' and the end moment of the falling edge of the second switching control signal CKH2, the end moment of the functional rising edge of the compensation control signal CKH' may be before the end moment of the falling edge of the second switching control signal CKH2, or the end moment of the functional rising edge of the compensation control signal CKH' may be the same as the end moment of the falling edge of the second switching control signal CKH2, or the end moment of the functional rising edge of the compensation control signal CKH' may be after the end moment of the falling edge of the second switching control signal CKH2.

Figure 16:
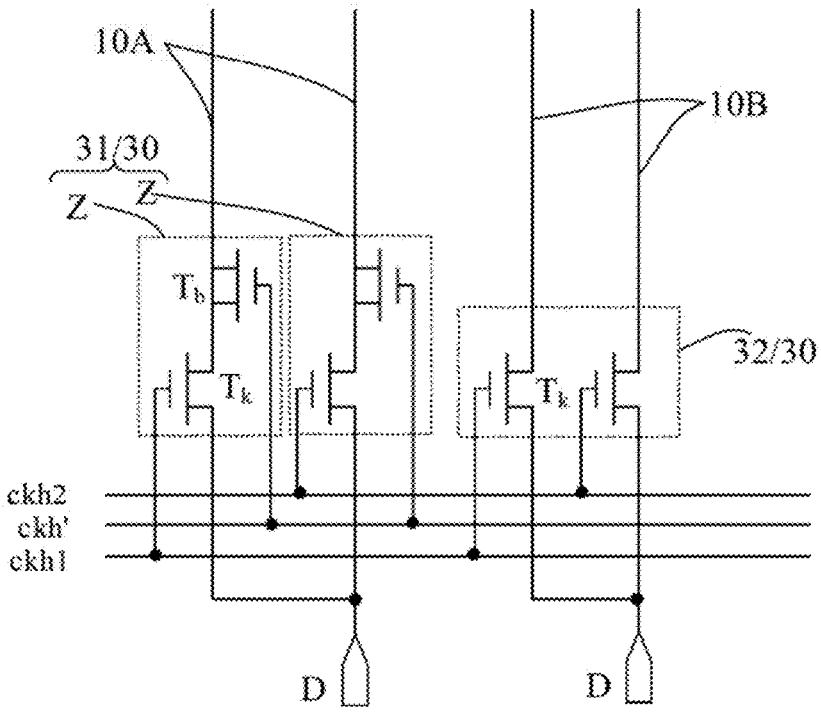
FIG. 16 is a schematic diagram of a display panel according to an embodiment of the present disclosure.

In some embodiments, FIG. 16 is a schematic diagram of a display panel according to an embodiment of the present disclosure. As shown in FIG. 16, the data lines 10 extend along the first direction X. The data lines 10 includes a first data line 10A and a second data line 10B. A length of the first data line 10A is less than a length of the second data line 10B in the display region AA. The second electrode of the switching transistor $T_k$ in the first demultiplexer 31 is coupled with the first data line 10A. The demultiplexer 30 further includes a second demultiplexer 32. The second electrode of the switching transistor $T_k$ in the second demultiplexer 32 is coupled with the second data line 10B. The second demultiplexer 32 does not include the compensation transistor $T_b$. If the lengths of the first data line 10A and the second data line 10B are different, the loads of the first data line 10A and the second data line 10B are different. If the length of the second data line 10B is greater than the length of the first data line 10A, the second data line 10B has a stronger anti-coupling capability. That is, the first data line 10A is seriously affected by the falling edge of the switching control signal CKH, and the data voltage written to the second data line 10B is more stable. In the embodiment of the present disclosure, the structures of the demultiplexers 30 are set to be different, the compensation transistor $T_b$ is added in the first demultiplexer 31 coupled with the first data line 10A. The rising edge of the compensation control signal CKH' received by the compensation transistor $T_b$ makes the voltage on the first data line 10A increase by coupling, to compensate the effect on the first data line 10A caused by the falling edge of the switching control signal CKH, thereby reducing or even eliminating a feed-through voltage on the first data line 10A caused by the switching control signal, so that a voltage actually written to the first data line 10A is substantially the same as a voltage supplied to the first data line 10A. When the AC driving manner is adopted, it can be ensured that when a uniform common voltage is supplied to the display region, a voltage difference between a positive polarity voltage transmitted on the data line 10 and the common voltage is basically the same as a voltage difference between a negative polarity voltage transmitted on the data line 10 and the common voltage, thereby improving the display flickering phenomenon.

FIG. 17 is a schematic diagram of a display panel according to an embodiment. As shown in FIG. 17, the display region AA has a gap K, and a part of the edge of the display region AA is recessed into the display region AA along the first direction X to form the gap K. The display panel includes a first data line 10A and a second data line 10B. The length of the first data line 0A is less than the length of the second data line 10B. The first data line 10A is located a display region adjacent to the gap K in the first direction X. In the second direction Y, the second data lines 10B are located on both sides of the gap K. In the design of the present disclosure, the first data line 10A is coupled with the first demultiplexer 31, and the second data line 10B is coupled with the second demultiplexer 32.

In some embodiments, the switching control line ckh is connected to the signal input terminal, and the signal input terminal transmits the switching control signal to the switching control line ckh. Due to the existence of a voltage drop on the switching control line ckh, there is a delay in transmission of the switching control signal on the switching control line ckh. A greater distance from the signal input terminal results in a more serious delay of the switching control signal. That is, a greater transmission distance of the switching control signal on the switching control line ckh results in a more serious delay. In the non-display region NA, multiple demultiplexers 30 are arranged along the second direction Y, the switching control line ckh extends along the second direction Y. and the demultiplexers 30 are coupled with the switching control line ckh. The delays of the switching control signals received by the demultiplexers 30 at different positions in a direction b are different. The delay of the switching control signal results in a smoother falling edge of the switching control signal, and the smoother falling edge of the switching control signal results in a less coupling effect on the data line 10. As a result, the data lines 10 coupled with the demultiplexers 30 at different positions are affected by coupling of the falling edge of the switching control signal for different degrees. A greater distance from the signal input terminal results in a less effect on the data line 10 caused by the falling edge of the switching control signal. In the embodiment of the present disclosure, the structures of the demultiplexers 30 arranged along the second direction Y are set to be different, the demultiplexers 30 include the first demultiplexer 31 and the second demultiplexer 32. The compensation transistor $T_b$ is provided in the first demultiplexer 31 and is not provided in the second demultiplexer 32. The first demultiplexer 31 is arranged at a position close to the signal input terminal, and the second demultiplexer 32 is arranged at a position farther away from the signal input terminal. The functional rising edge of the compensation control signal CKH' received by the compensation transistor $T_b$ in the first demultiplexer 31 makes the voltage on the data line 10 increase by coupling, to compensate the coupling effect on the first data line 10 caused by the falling edge of the switching control signal CKH, thereby reducing or even eliminating a feed-through voltage on the data line 10, coupled with the demultiplexer close to the signal input terminal, caused by the switching control signal CKH, to improve the display flickering phenomenon.

Figure 18:
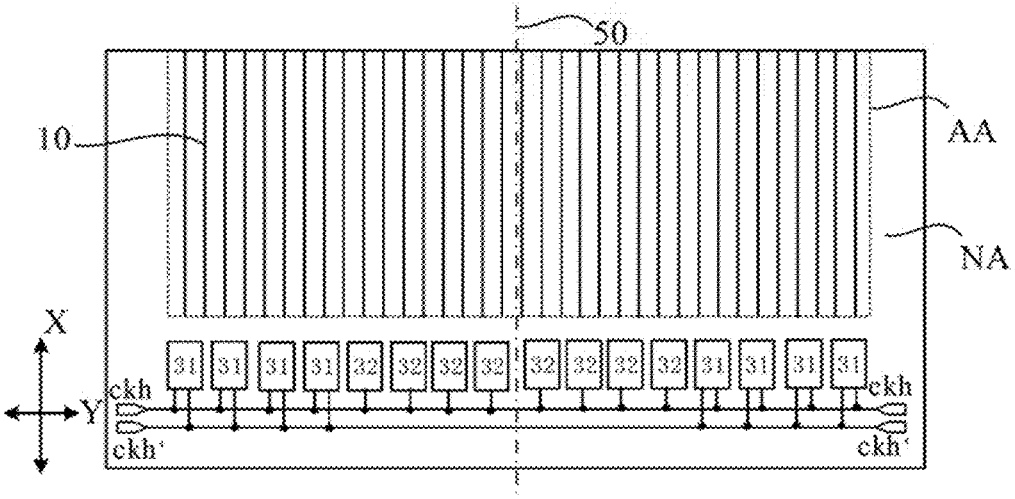
FIG. 18 is a partial schematic diagram of a display panel according to an embodiment of the present disclosure.

In some embodiments, FIG. 18 is a partial schematic diagram of a display panel according to an embodiment of the present disclosure. As shown in FIG. 18, in the display region AA, the data lines 10 extend along the first direction X. The display panel has a symmetry axis 50 extending along the first direction X. Multiple demultiplexers 30 in the non-display region NA are arranged along the second direction Y. A switching control line CKH is provided in the non-display region NA, and the control electrode of the switching transistor $T_k$ is coupled with a corresponding switching control line ckh.

As shown in FIG. 18, the switching transistors $T_k$ in the demultiplexers 30 arranged in the second direction Y are all coupled with the switching control line ckh, so it is usually set that a voltage signal is inputted at both ends of the switching control line CKH in the second direction Y. The switching control signal is transmitted from the two ends to the middle in the second direction Y, that is to say, two end positions of the switching control line ckh in the second direction Y are closer to the signal input terminal, and a middle position of the switching control line ckh in the second direction Y is far from the signal input terminal. It may also be said that the two end positions of the switching control line ckh in the second direction Y are near ends of the signal input terminal, and the middle position of the switching control line ckh in the second direction Y is a far end of the signal input terminal. As a result, delays of the switching control signals received by the demultiplexers 30 at different positions are different. A less distance from the symmetry axis 50 in the second direction Y results in a more serious delay of the switching control signal. The delay of the switching control signal results in a smoother falling edge of the switching control signal, and then results in a less coupling effect on the data line 10 caused by the falling edge of the switching control signal. As a result, the data lines 10 coupled with the demultiplexers 30 at different positions are affected by coupling of the falling edge of the switching control signal for different degrees. A greater distance between the demultiplexer 30 and the symmetry axis 50 results in a greater effect on the data line 10 coupled with the demultiplexer 30 caused by the falling edge of the switching control signal, a lower voltage on the data line 10 caused by coupling of the falling edge of the switching control signal, and a greater feed-through voltage on the data line 10. Correspondingly, the data line 10 coupled with the demultiplexer 30 close to the symmetry axis 50 is less affected by coupling of the falling edge of the switching control signal. As a result, there is an obvious display flickering phenomenon in the areas on the left and right sides of the display region AA along the second direction Y.

In the embodiment of the present disclosure, the demultiplexers 30 include a first demultiplexer 31 and a second demultiplexer 32. The first demultiplexer 31 is provided with the compensation transistor $T_b$, and the second demultiplexer 32 is not provided with the compensation transistor $T_b$. The structures of the first demultiplexer 31 and the second demultiplexer 32 may be understood with reference to the above-mentioned FIG. 16. A compensation control line ckh' is also provided in the non-display region NA, and the control electrode of the compensation transistor $T_b$ is coupled with the corresponding compensation control line ckh'. On one side of the symmetry axis 50, in the second direction Y, a distance between the first demultiplexer 31 to the symmetry axis 50 is greater than a distance between the second demultiplexer 32 to the symmetry axis 50. The rising edge of the compensation control signal CKH' received by the compensation transistor $T_b$ in the first demultiplexer 31 makes the voltage on the data line 10 increase, to compensate the coupling effect on the first data line 10 caused by the falling edge of the switching control signal, thereby reducing or even eliminating a feed-through voltage on the data line 10, coupled with the demultiplexer far from the symmetry axis 50, caused by the switching control signal, to improve the display flickering phenomenon in the areas on the left and right sides of the display region AA along the second direction Y.

In some embodiments, multiple demultiplexers 30 are arranged along the second direction Y, and the demultiplexers 30 include a first demultiplexer 31 and a second demultiplexer 32. The first demultiplexer 31 is provided with the compensation transistor $T_b$, the second demultiplexer 32 is not provided with the compensation transistor $T_b$. p first demultiplexers 31 arranged along the second direction Y form a first group, and q second demultiplexers 32 arranged along the second direction Y form a second group, where both p and q are positive integers. The first group and the second group are alternately arranged along the second direction Y. The number of the first demultiplexers in the first group gradually decreases in a direction from the near end to the far end of the signal input terminal of the switching control line ckh. In this embodiment, in the direction from the near end to the far end of the signal input terminal of the switching control line ckh, the first demultiplexers 31 and the second demultiplexers 32 are alternately arranged, and the number of first demultiplexers 31 in two adjacent second demultiplexers 32 gradually decreases. The alternate arrangement of the first demultiplexers 31 and the second demultiplexers 32 make the flickering pixel columns be alternately arranged, which is not easy to be detected by the human eye, thereby weakening the display flickering phenomenon.

Figure 19:
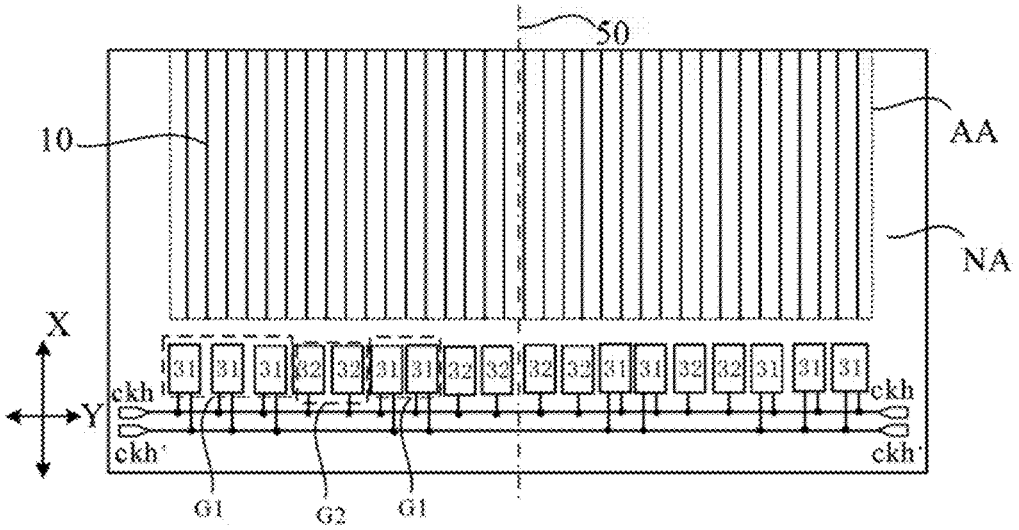
FIG. 19 is a partial schematic diagram of a display panel according to an embodiment of the present disclosure.

In some embodiments, FIG. 19 is a partial schematic diagram of a display panel according to an embodiment of the present disclosure. As shown in FIG. 19, in the display region AA, the data lines 10 extend along the first direction X. The display panel has a symmetry axis 50 extending along the first direction X. Multiple demultiplexers 30 in the non-display region NA are arranged along the second direction Y. The demultiplexers 30 include a first demultiplexer 31 and a second demultiplexer 32. The first demultiplexer 31 is provided with the compensation transistor $T_b$, the second demultiplexer 32 is not provided with the compensation transistor $T_b$. On one side of the symmetry axis 50, p first demultiplexers 31 arranged along the second direction Y form a first group G1, and q second demultiplexers 32 arranged along the second direction Y form a second group G2. The first group G1 and the second group G2 are alternately arranged along the second direction Y. The number of the first demultiplexers in the first group G1 gradually decreases in a direction of approaching the symmetry axis 50. Both p and q are positive integers, the specific values of p and q are not limited in the embodiments of the present disclosure. As shown in FIG. 19, at the left side of the symmetry axis 50, from left to right, the first first group G1 includes 3 first demultiplexers 31, and the second first group G1 includes 2 first demultiplexers 31. The rising edge of the compensation control signal CKH' received by the compensation transistor $T_b$ in the first demultiplexer 31 makes the voltage on the data line 10 increase, to compensate the coupling effect on the first data line 10 caused by the falling edge of the switching control signal, thereby reducing or even eliminating a feed-through voltage on the data line 10, coupled with the first demultiplexer 31, caused by the switching control signal. However, the second demultiplexer 32 is not provided with the compensation transistor $T_b$, there may be a flickering phenomenon in the area where the data line 10 coupled with the second demultiplexer 32 is located. In this embodiment of the present disclosure, the first demultiplexers 31 and the second demultiplexers 32 are alternately arranged, so that the flickering pixel columns are alternately arranged, which is not easy to be detected by the human eye, thereby weakening the display flickering phenomenon. Moreover, this arrangement can reduce the number of the arranged first demultiplexers 31, thereby saving the space of the non-display region NA.

In other embodiments, at least part of the demultiplexers 30 arranged in the second direction Y are grouped, the number of demultiplexers 30 in each group is the same, and each group includes the first demultiplexer 31 and the second demultiplexer 32. The number of the first demultiplexers in the group gradually decreases in a direction from the near end to the far end of the signal input terminal of the switching control line ckh. In this embodiment, the alternate arrangement of the first demultiplexers 31 and the second demultiplexers 32 make the flickering pixel columns be alternately arranged, which is not easy to be detected by the human eye, thereby weakening the display flickering phenomenon.

In some embodiments, the display panel has a symmetry axis extending along the first direction X. Multiple demultiplexers 30 located on one side of the symmetry axis in the second direction Y are grouped, and the number of the demultiplexers 30 in each group is the same, and each group includes the first demultiplexer 31 and the second demultiplexer 32. A less distance from the symmetry axis along the second direction Y indicates a smaller number of the first demultiplexers 31 in the group.

In some embodiments, all the demultiplexers 30 of the display panel are provided with the compensation transistor $T_b$, which are not shown in the drawings herein.

Figure 20:
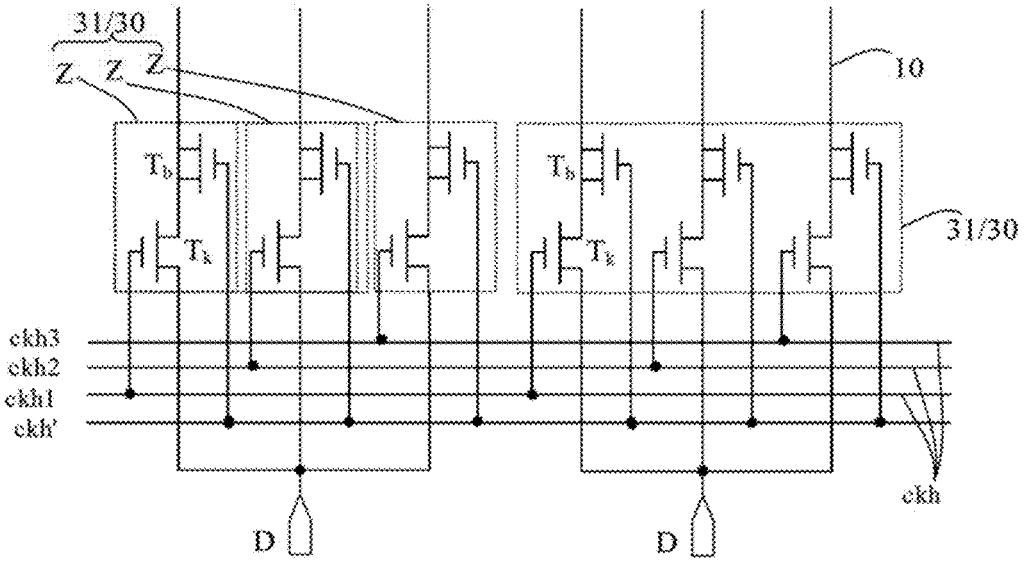
FIG. 20 is a schematic diagram of a display panel according to an embodiment of the present disclosure.

In the above embodiments, m=2 is used for illustration. In some embodiments, FIG. is a schematic diagram of a display panel according to an embodiment of the present disclosure. As shown in FIG. 20, m=3, that is, the demultiplexer 30 has three branches Z. The branch Z of the first demultiplexer 31 is provided with the compensation transistor $T_b$. In the embodiment of FIG. 20, the control electrodes of the compensation transistors $T_b$ in the branches Z are all coupled with the same compensation control line ckh'. In some embodiments, the control electrode of the compensation transistor $T_b$ in each branch Z is coupled with a corresponding compensation control lines ckh', and the number of the compensation control lines ckh' is equal to the number of the branches Z, which are not shown in the drawings herein.

The embodiment of the present disclosure does not limit the value of m. The embodiment of the present disclosure may also be applied to the display panel including m demultiplexers, where m=6, which are not shown in the drawings herein.

Figure 21:
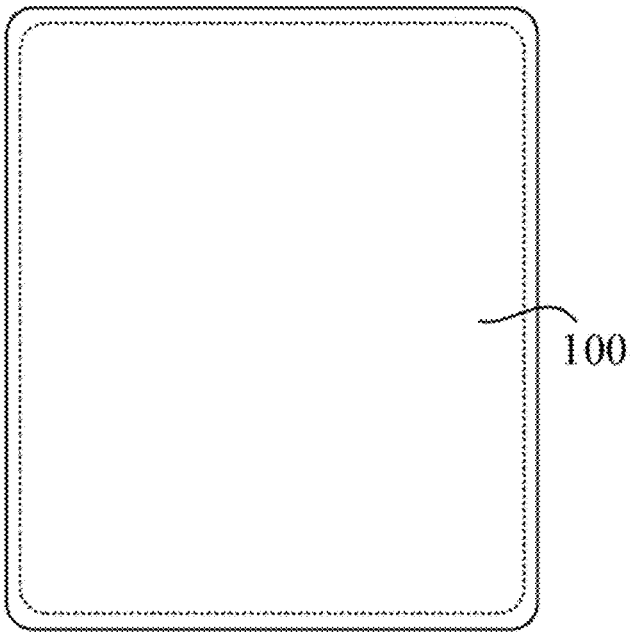
FIG. 21 is a schematic diagram of a display device according to an embodiment of the present disclosure.

Some embodiments of the present disclosure provide a display device. FIG. 21 is a schematic diagram of the display device provided by the embodiment of the present disclosure. As shown in FIG. 21, the display device includes the display panel 100 provided by any embodiment of the present disclosure. The structure of the display panel 100 has been described in the above embodiments and will not be repeated herein. The display device provided by the embodiment of the present disclosure can be any device with a display function, such as a mobile phone, a tablet computer, a notebook computer, or a television.

The above are only exemplary embodiments of the present disclosure and are not intended to limit the present disclosure. Any modification, equivalent replacement, or improvement made within the spirit and principle of the present disclosure should be included in the scope of the present disclosure.

Finally, it should be noted that the above embodiments are only used to illustrate the technical solution of the present disclosure but not to limit it; although the present disclosure has been described in detail with reference to the embodiments above, those of ordinary skill in the art should understand that they can still modify the technical solutions described in the embodiments above or make equivalent replacement of some or all of the technical features; whereas these modifications or replacements do not cause the essence of the corresponding technical solutions to depart from the scope of the technical solutions of the embodiments of the present disclosure.

What is claimed is:

1. A display panel, having a display region and a non-display region, wherein the display panel comprises:

data lines arranged in the display region;

scanning lines arranged in the display region; and at least one demultiplexer arranged in the non-display region, wherein each demultiplexer of the at least one demultiplexer comprises m branches, where m is an integer, and m≥2, wherein each of the m branches comprises a switching transistor, wherein the switching transistor comprises a first electrode coupled with an input terminal of the demultiplexer, a second electrode coupled with one of the data lines, and a control electrode configured to receive a switching control signal;

wherein the at least one demultiplexer comprises at least one first demultiplexer, wherein each of m branches of each of the at least one first demultiplexer comprises a compensation transistor, wherein the compensation transistor comprises a first electrode coupled with the second electrode of the switching transistor, a second electrode coupled with the first electrode of the compensation transistor, and a control electrode configured to receive a compensation control signal; and wherein the compensation control signal received by the compensation transistor has one functional rising edge within a period during which one of the scanning lines provides an effective level signal once.

2. The display panel according to claim 1, further comprising:

m switching control lines; and m compensation control lines, wherein the m switching transistors of the m branches in one of the at least one demultiplexer are respectively coupled with the m switching control lines, and each of the m switching control lines is configured to provide the switching control signal to one of the m switching transistors that is coupled with the switching control line; and the m compensation transistors of the m branches in one of the at least one first demultiplexer are respectively coupled with the m compensation control lines, and each of the m compensation control lines is configured to provide the compensation control signal to one of the m compensation transistors that is coupled with the compensation control line.

3. The display panel according to claim 1, further comprising:

m switching control lines; and a compensation control line, wherein the m switching transistors of the m branches in one of the at least one demultiplexer are respectively coupled with the m switching control lines, and each of the m switching control lines is configured to provide the switching control signal to one of the m switching transistors that is coupled with the switching control line; and the m compensation transistors of the m branches in one of the at least one first demultiplexer are coupled with the compensation control line, and the compensation control line is configured to provide the compensation control signal to the m compensation transistors coupled with the compensation control line.

4. The display panel according to claim 1, wherein within the period during which the one of the scanning lines provides the effective level signal once, in one branch of the m branches of one of the at least one first demultiplexer, a falling edge of the switching control signal received by the switching transistor in the one of the m branches has a first critical moment, wherein the switching transistor in the one of the m branches is turned off at the first critical moment, and an end moment of the functional rising edge of the compensation control signal is not earlier than the first critical moment.

5. The display panel according to claim 4, wherein within the period during which the one of the scanning lines provides the effective level signal once, in at least one branch of the m branches of one of the at least one first demultiplexer, the functional rising edge of the compensation control signal has a second critical moment, wherein the compensation transistor in the at least one branch is turned on at the second critical moment, and the second critical moment is not earlier than the first critical moment.

6. The display panel according to claim 4, wherein within the period during which the one of the scanning lines provides the effective level signal once, each of the m branches of one of the at least one first demultiplexer receives the compensation control signal.

7. The display panel according to claim 6, wherein within the period during which the one of the scanning lines provides the effective level signal once, in one branch of the m branches of one of the at least one first demultiplexer, the end moment of the functional rising edge is earlier than an end moment of the falling edge of the switching control signal.

8. The display panel according to claim 6, wherein a ratio of a duration of a low level signal in the compensation control signal to a waveform cycle of the compensation control signal is equal or unequal to a ratio of a duration of a high level signal in the switching control signal to a waveform cycle of the switching control signal.

9. The display panel according to claim 4, wherein within the period during which the one of the scanning lines provides the effective level signal once, the m compensation transistors in the m branches of one of the at least one first demultiplexer receive the compensation control signals with a same value.

10. The display panel according to claim 9, wherein within the period during which the one of the scanning lines provides the effective level signal once, the end moment of the functional rising edge is not earlier than the first critical moment of a last falling edge of the falling edges of the m switching control signals received by the m switching transistors in the m branches of the one of the at least one first demultiplexer.

11. The display panel according to claim 9, wherein within the period during which the one of the scanning lines provides the effective level signal once, the compensation control signal has a falling edge having a third critical moment, wherein the compensation transistor is turned off at the third critical moment, and the third critical moment is not later than the first critical moment of a first falling edge of the falling edges of the m switching control signals received by the m switching transistors in the m branches of the one of the at least one first demultiplexer.

12. The display panel according to claim 9, wherein a ratio of a duration of a high level signal in the compensation control signal to a waveform cycle of the compensation control signal is equal or unequal to a ratio of a duration of a high level signal in the switching control signal to a waveform cycle of the switching control signal.

13. The display panel according to claim 4, wherein within the period during which the one of the scanning lines provides the effective level signal once, the compensation control signal does not have a falling edge after the functional rising edge.

14. The display panel according to claim 1, wherein both the switching transistor and the compensation transistor are n-type transistors.

15. The display panel according to claim 1, wherein a width to length ratio of the switching transistor is the same as a width to length ratio of the compensation transistor, or a channel area of the compensation transistor is smaller than a channel area of the switching transistor.

16. The display panel according to claim 15, wherein when the width to length ratio of the switching transistor is the same as the width to length ratio of the compensation transistor, a difference $\Delta V_1$ between a voltage of a high level signal and a voltage of a low level signal in the compensation control signal and a difference $\Delta V_2$ between a voltage of a high level signal and a voltage of a low level signal in the switching control signal satisfy: $\Delta V_1=\Delta V_2$, or when the channel area of the compensation transistor is smaller than the channel area of the switching transistor, a difference $\Delta V_1$ between a voltage of a high level signal and a voltage of a low level signal in the compensation control signal and a difference $\Delta V_2$ between a voltage of a high level signal and a voltage of a low level signal in the switching control signal satisfy: $\Delta V_1>\Delta V_2$.

17. The display panel according to claim 15, wherein the data lines each extend along a first direction; and when the width to length ratio of the switching transistor is the same as the width to length ratio of the compensation transistor, in each of the m branches of one of the at least one first demultiplexer, the compensation transistor and the switching transistor are arranged along a second direction intersecting the first direction; or when the channel area of the compensation transistor is smaller than the channel area of the switching transistor, in each of the m branches of one of the at least one first demultiplexer, the compensation transistor is located at a side of the switching transistor close to the display region in a second direction, wherein the first direction and the second direction intersect each other.

18. The display panel according to claim 1, wherein the data lines comprise a first data line and a second data line, wherein a length of the first data line is smaller than a length of the second data line;

the second electrode of the switching transistor in one of the at least one first demultiplexer is coupled with the first data line; and the at least one demultiplexer further comprises a second demultiplexer, the second electrode of the switching transistor in the second demultiplexer is coupled with the second data line.

19. The display panel according to claim 1, wherein the data lines each extend along a first direction in the display region, and the display panel has a symmetry axis extending along the first direction; and the at least one demultiplexer comprises a plurality of demultiplexers, wherein the plurality of demultiplexers is arranged along a second direction, wherein the first direction and the second direction intersect each other, and the plurality of demultiplexers further comprises at least one second demultiplexer; and at a side of the symmetry axis, a distance from one of the at least one first demultiplexer to the symmetry axis along the second direction is greater than a distance from one of the at least one second demultiplexer to the symmetry axis along the second direction; or the at least one first demultiplexer comprises a plurality of first demultiplexers, the at least one second demultiplexer comprises a plurality of second demultiplexers, and at a side of the symmetry axis, p first demultiplexers of the plurality of first demultiplexers are arranged along the second direction to form one of first groups, and q second demultiplexers of the plurality of second demultiplexers are arranged along the second direction to form one of second groups, wherein the first groups and the second groups are alternately arranged along the second direction; and numbers of the first demultiplexers in the first groups gradually decreases in a direction towards the symmetry axis, where both p and q are positive integers.

20. A display device comprising a display panel, wherein the display panel has a display region and a non-display region and comprises:

data lines arranged in the display region;

scanning lines arranged in the display region; and at least one demultiplexer arranged in the non-display region, wherein each demultiplexer of the at least one demultiplexer comprises m branches, where m is an integer, and m≥2, wherein each of the m branches comprises a switching transistor, wherein the switching transistor comprises a first electrode coupled with an input terminal of the demultiplexer, a second electrode coupled with one of the data lines, and a control electrode configured to receive a switching control signal; wherein the at least one demultiplexer comprises at least one first demultiplexer, wherein each of m branches of each of the at least one first demultiplexer comprises a compensation transistor, wherein the compensation transistor comprises a first electrode coupled with the second electrode of the switching transistor, a second electrode coupled with the first electrode of the compensation transistor, and a control electrode configured to receive a compensation control signal; and wherein the compensation control signal received by the compensation transistor has one functional rising edge within a period during which one of the scanning lines provides an effective level signal once.

* * * * *